US007516508B2

(12) United States Patent
Stackpole, Jr. et al.

(10) Patent No.: US 7,516,508 B2
(45) Date of Patent: Apr. 14, 2009

(54) MOTORIZED CLEANING IMPLEMENT

(75) Inventors: A. Bryon Stackpole, Jr., Mason, OH (US); Thomas George Crowe, Lawrenceburg, IN (US); Matthew Lloyd Newman, Lawrenceburg, IN (US); Ramona Zenkich, Mt. Lookout, OH (US); Tracey Ann Wurzelbacher, Hamilton, OH (US); Eric Young Park, Portland, OR (US); Ildefonso Mendoza Resuello, Jr., Portland, OR (US); David John Sayler, Portland, OR (US)

(73) Assignee: The Procter & Gamble Company, Cincinnati, OH (US)

( * ) Notice: Subject to any disclaimer, the term of this patent is extended or adjusted under 35 U.S.C. 154(b) by 499 days.

(21) Appl. No.: 11/070,145

(22) Filed: Mar. 2, 2005

(65) Prior Publication Data

US 2006/0059639 A1 Mar. 23, 2006

Related U.S. Application Data

(63) Continuation-in-part of application No. 10/934,875, filed on Sep. 3, 2004.

(60) Provisional application No. 60/636,432, filed on Dec. 15, 2004, provisional application No. 60/572,146, filed on May 18, 2004, provisional application No. 60/499,851, filed on Sep. 3, 2003.

(51) Int. Cl.
*A47L 11/02* (2006.01)
*A47L 11/12* (2006.01)

(52) U.S. Cl. ..... 15/97.1; 15/98; 15/49.1

(58) Field of Classification Search ..... 15/97.1, 15/98, 22.2, 49.1, 209.1, 50.2, 52.2, 22.1, 15/40, 231
See application file for complete search history.

(56) References Cited

U.S. PATENT DOCUMENTS

| | | | | |
|---|---|---|---|---|
| 4,005,502 | A | 2/1977 | Stevens | |
| 5,311,634 | A * | 5/1994 | Andros | 15/97.1 |
| 5,862,565 | A | 1/1999 | Lundstedt | |
| 6,543,082 | B2 | 4/2003 | Dingert et al. | |
| 7,013,528 | B2 * | 3/2006 | Parker et al. | 15/403 |
| 2002/0129835 | A1 * | 9/2002 | Pieroni et al. | 134/6 |
| 2003/0167585 | A1 * | 9/2003 | Chen | 15/97.1 |
| 2004/0103490 | A1 * | 6/2004 | Long et al. | 15/22.1 |
| 2004/0107522 | A1 | 6/2004 | Paas | |

FOREIGN PATENT DOCUMENTS

| | | | |
|---|---|---|---|
| DE | 43 44 737 | A1 | 6/1995 |
| JP | P2001-231714 | A | 8/2001 |
| WO | WO 2005/023080 | A2 | 3/2005 |

OTHER PUBLICATIONS

U.S. Appl. No. 10/934,875, filed Sep. 3, 2004, Goh et al.
PCT Search Report, 6 Pages, Mailed May 22, 2006.

* cited by examiner

*Primary Examiner*—Shay L Karls
(74) *Attorney, Agent, or Firm*—Thibault Fayette; Julia A. Glazer; Kim W. Zerby

(57) ABSTRACT

A motorized cleaning implement is provided for cleaning surfaces with a cleaning substrate. The motorized cleaning implement includes a bumper pad that is connected to a motor capable of providing a reciprocating motion to the bumper pad. A cleaning substrate which includes a pocket is attached to the bumper pad.

26 Claims, 34 Drawing Sheets

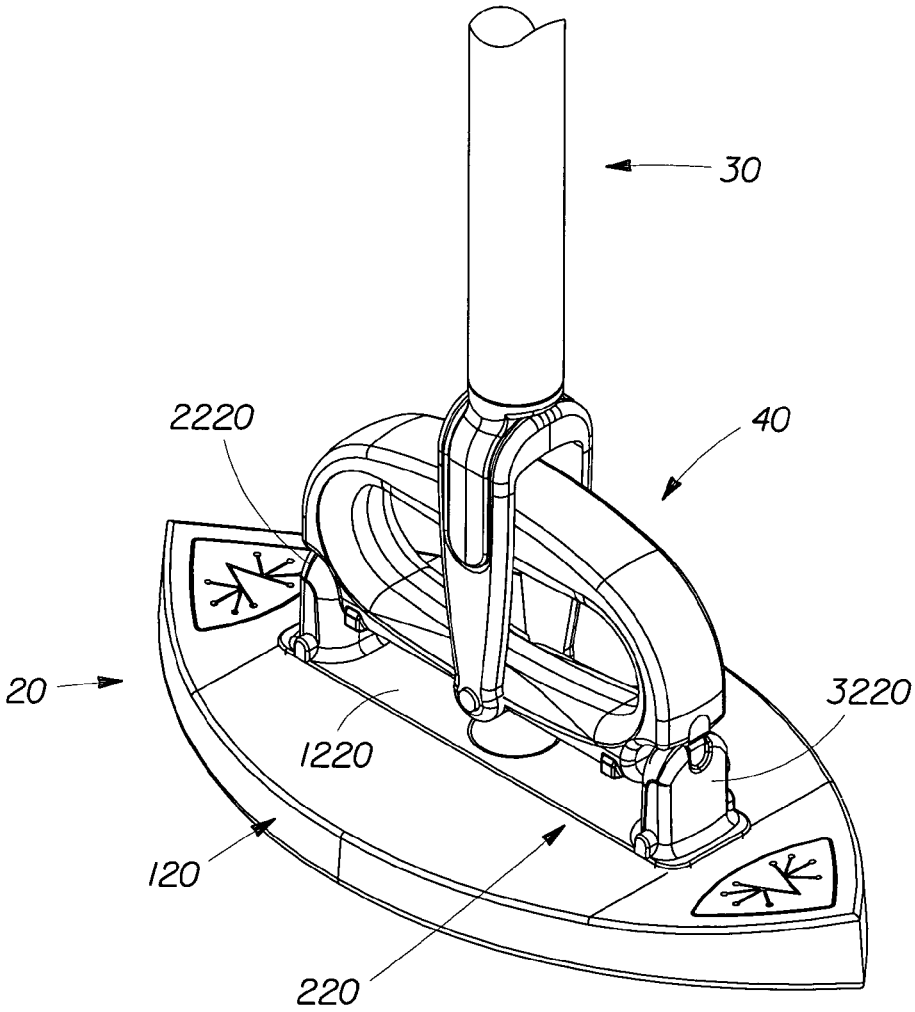
Fig. 3
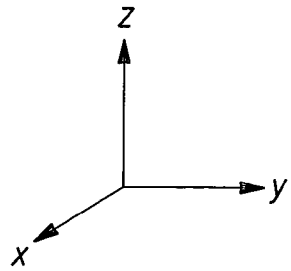

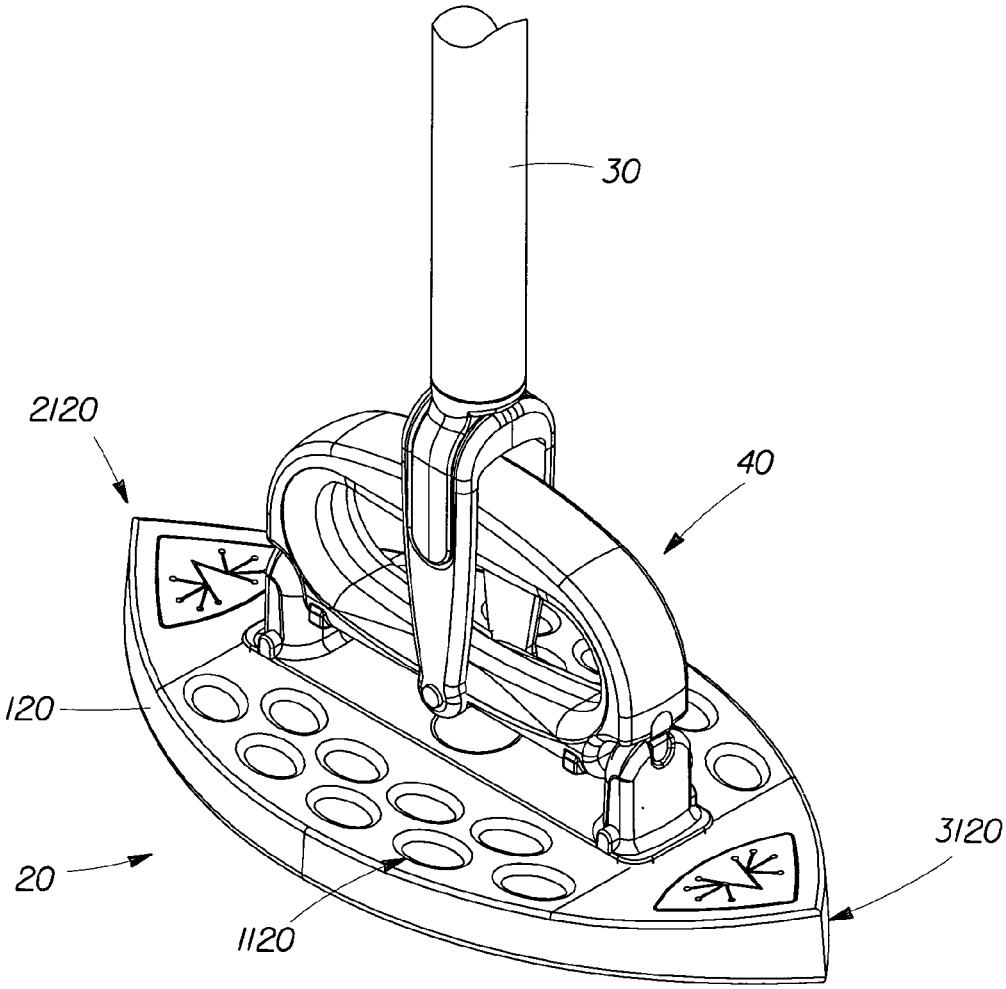
Fig. 6A
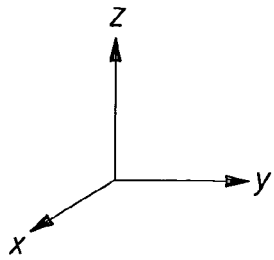

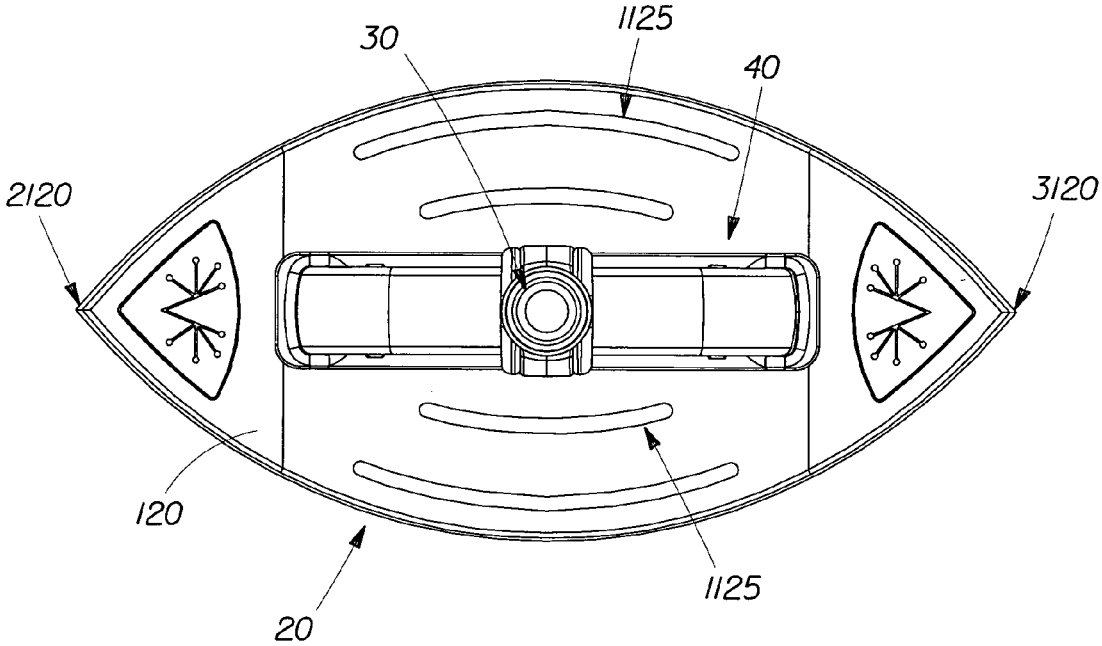
Fig. 6B
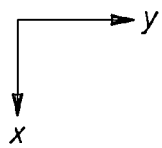

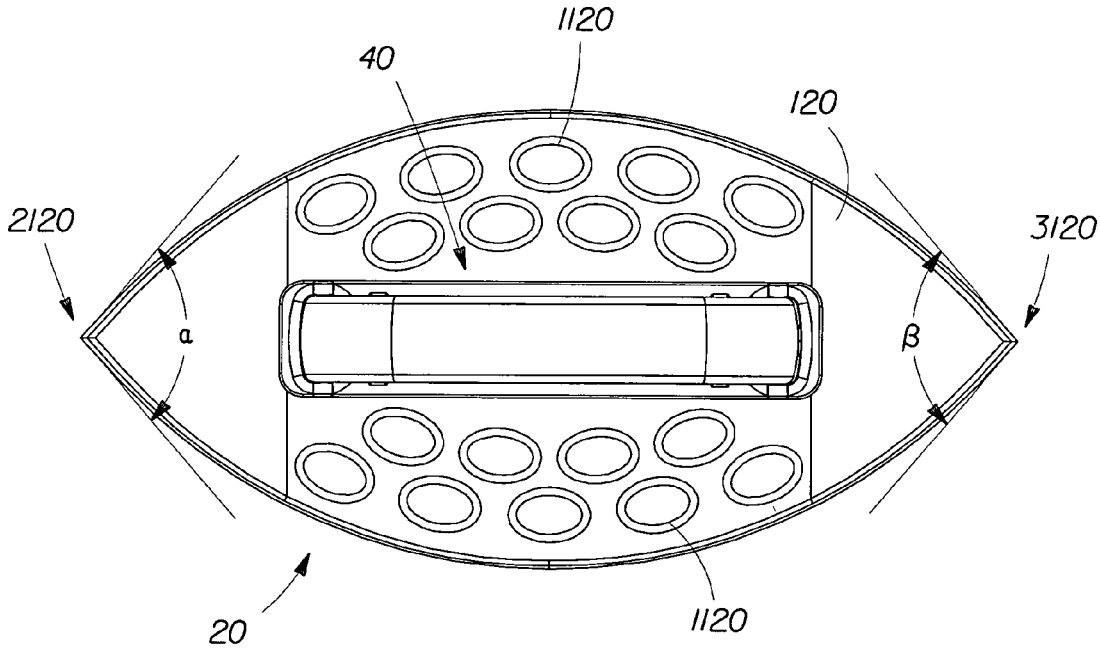
Fig. 7
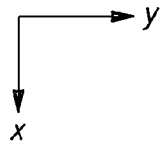

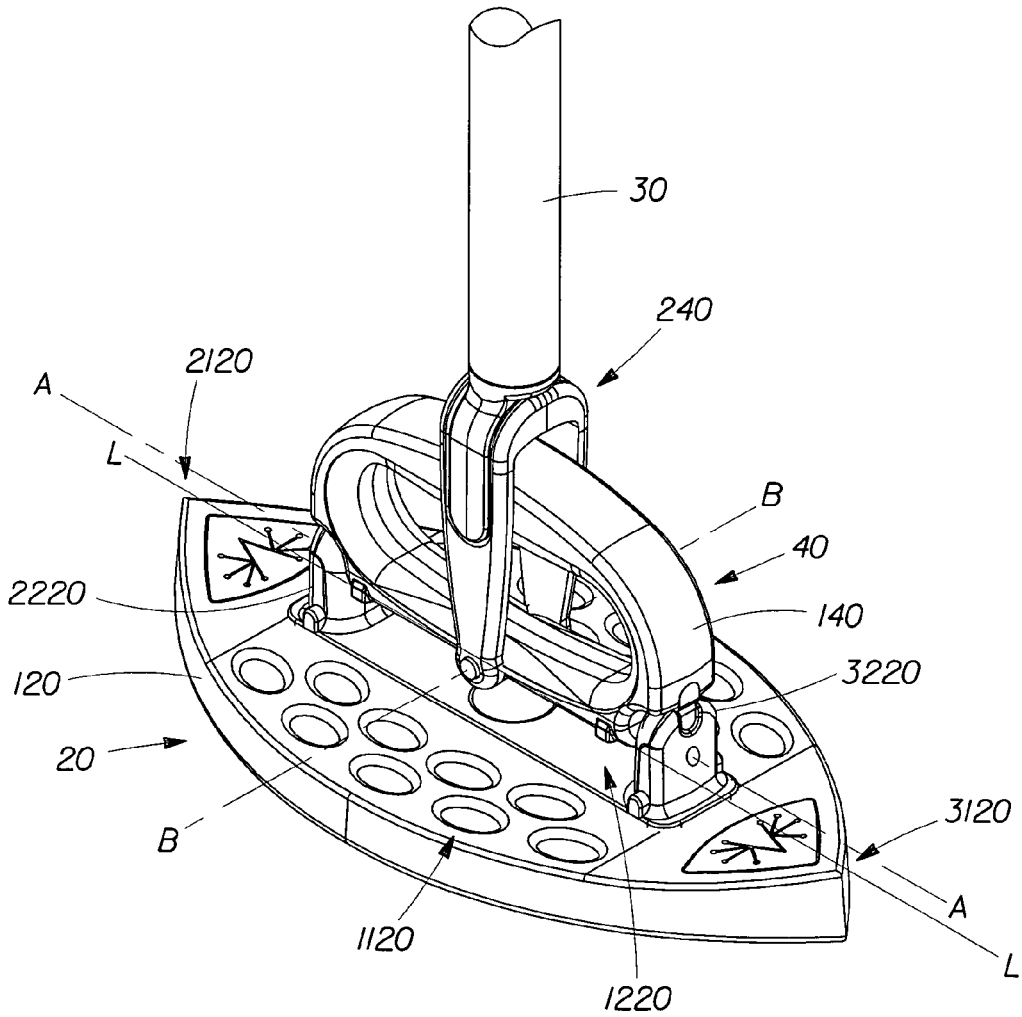
Fig. 9
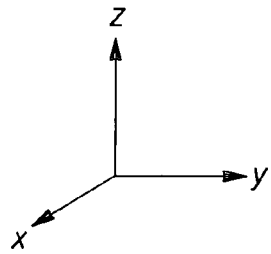

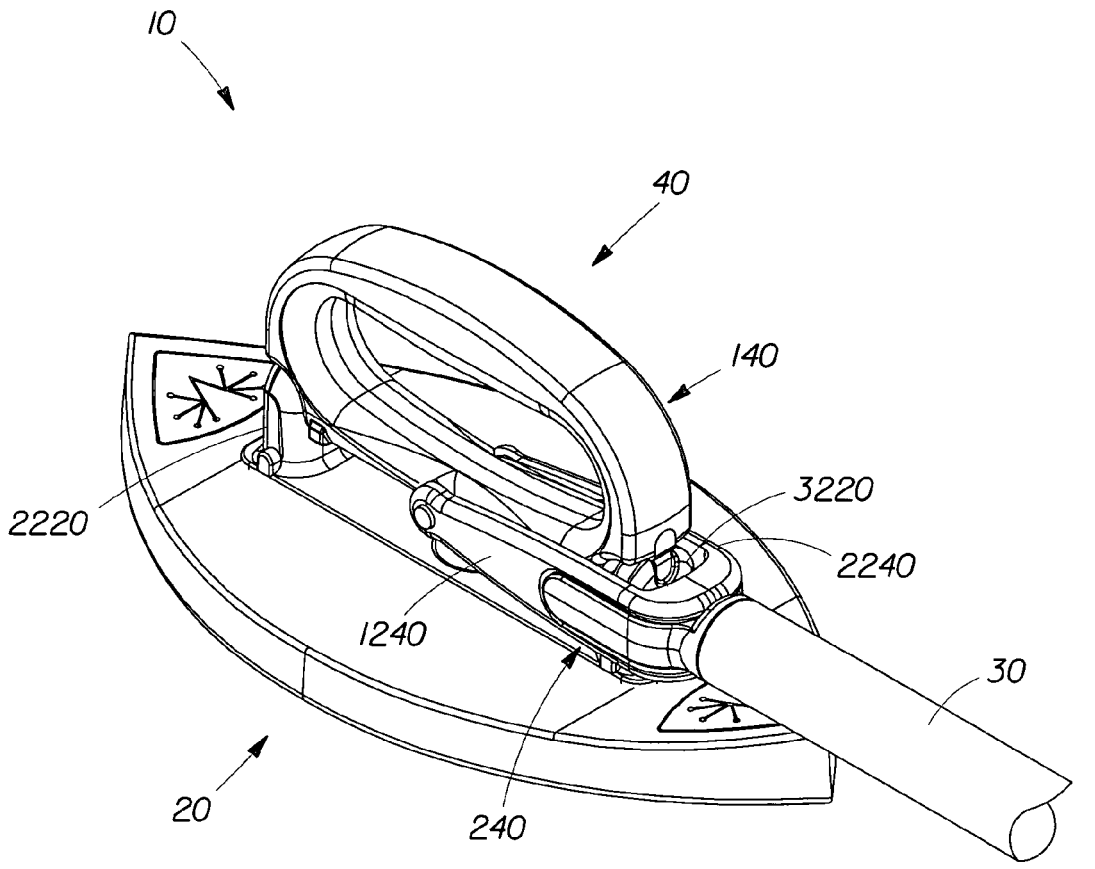
Fig. 11
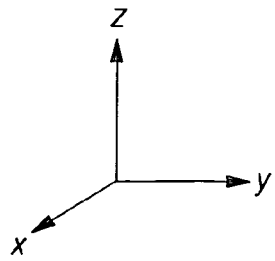

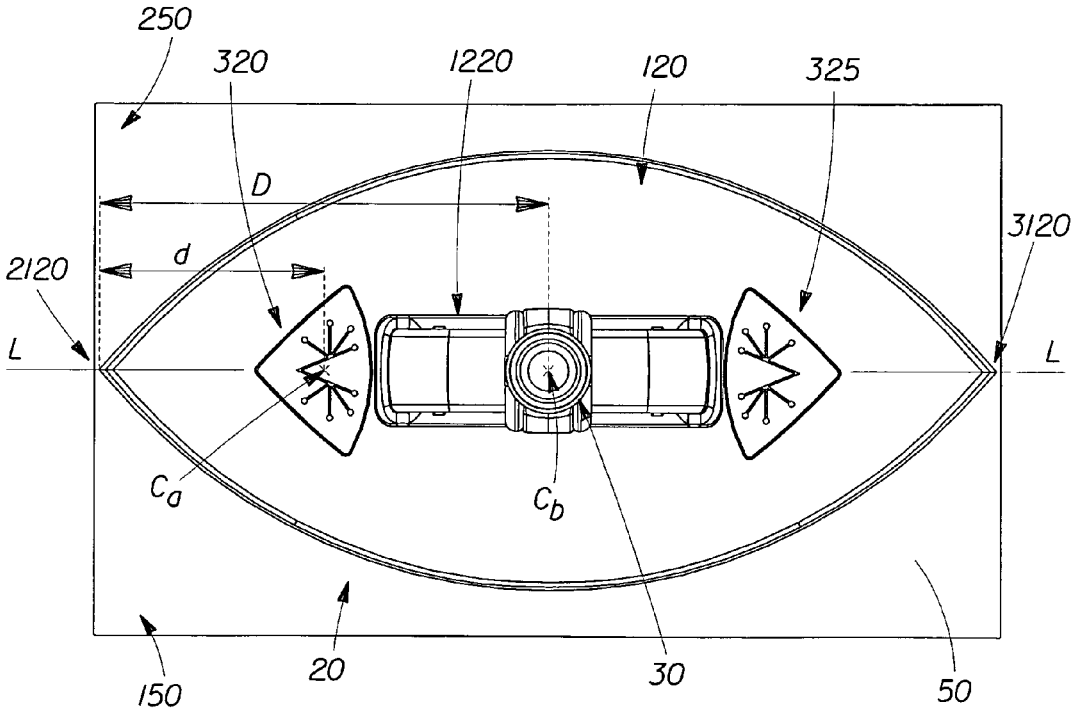
Fig. 12
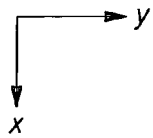

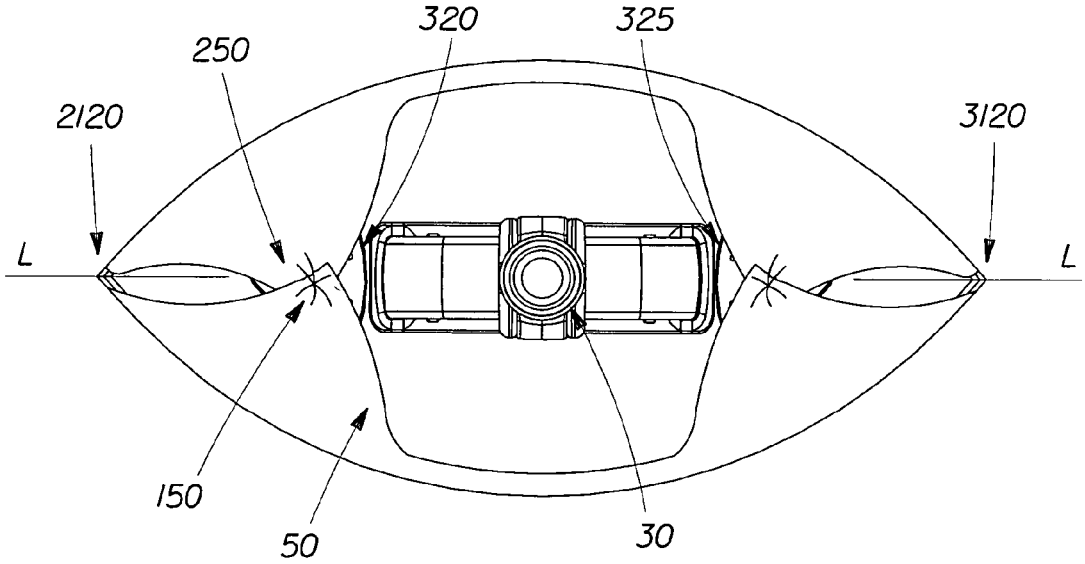
Fig. 13
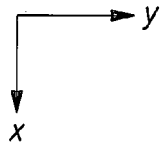

MOTORIZED CLEANING IMPLEMENT

CROSS REFERENCE TO RELATED APPLICATION

This application claims the benefit of U.S. Provisional Application No. 60/636,432, filed Dec. 15, 2004, and U.S. Provisional Application No. 60/572,146, filed May 18, 2004. This application is a continuation-in-part of U.S. application Ser. No. 10/934,875, filed on Sep. 3, 2004, which claims the benefit of U.S. Provisional Application No. 60/60/572,146, filed May 18, 2004; U.S. Provisional Application No. 60/499,851, filed Sep. 3, 2003.

TECHNICAL FIELD OF THE INVENTION

The present invention relates to the field of cleaning implements, and, more particularly, to the field of multi-purpose cleaning implements useful for cleaning hard surfaces such as floors, sinks, bathtubs, shower walls and the like.

BACKGROUND OF THE INVENTION

The literature is replete with products capable of cleaning flat hard surfaces such as ceramic tile floors, hardwood floors, counter tops and the like. In the context of cleaning flat surfaces, and in particular in the context of cleaning floors with a cleaning substrate, numerous devices are described comprising an elongated handle rotatably connected to a mop head via a universal joint. One example of such an implement is the SWIFFER® cleaning implement. The mop head of these implements includes typically a rigid support plate connected to a handle via a universal joint and a "bumper" or "cushion" pad located at the bottom of the rigid support plate and facing the surface to be cleaned. The "bumper" pad minimizes the risk that the flat surface might be damaged during the cleaning operation. In order to clean the flat surface, a user first attaches a cleaning substrate such as a disposable dry cleaning sheet (e.g. SWIFFER® cleaning sheet), or a disposable absorbent cleaning wipe or pad (e.g. a SWIFFER WET® pre-moistened cleaning pad), to slitted retaining structures located on the top surface of the support plate such that the cleaning substrate is "sandwiched" between the bumper pad and the surface to be cleaned, and then, wipes the flat surface with the chosen cleaning substrate. This type of implement used in combination with a disposable cleaning substrate has been shown to be convenient, easy to use and particularly hygienic as it limits the contact between the user's hand and the cleaning substrate, which is disposed of once the flat surface is cleaned. Nevertheless, the rigid support plate of this type of implement does not allow a user to clean curved surfaces effectively or efficiently, especially concave surfaces which are curved inwardly.

The literature is also replete with products capable of cleaning curved surfaces such as sinks, bathtubs and the like. Some of these products include cleaning solution which are applied directly on the surface to be cleaned and then rinsed off with water. Although these require minimum effort from the user, they generally do not provide the same cleaning efficacy as when a cleaning substrate is wiped against the surface to be cleaned. In order to enhance the cleaning performance, some cleaning products include cleaning substrates used in combination with a cleaning product. The most common of these are sponges. In order to clean a curved surface, a user typically holds the sponge in his or her hand and applies a cleaning solution either to the sponge or directly on the surface to be cleaned and then wipes this surface. Once the surface is clean, a user typically rinses this sponge and lets it dry such that it can be reused. Sponge materials (either natural or synthetic) are flexible and, as a result, they conform easily to the shape of the surface being cleaned. However, this type of reusable substrate becomes unsanitary over time and also requires the user to wear gloves to protect his or her hands depending on the "aggressiveness" of the cleaning solution which is used.

It is therefore one object of this invention to provide a cleaning implement which can be used with a disposable cleaning substrate in order to clean both flat, or curved surfaces in a convenient and hygienic manner.

It is also an object of this invention to provide a motorized cleaning implement which can be used with a disposable cleaning substrate in order to clean with minimum effort both flat and/or curved surfaces in a convenient and hygienic manner.

SUMMARY OF THE INVENTION

In one embodiment, the invention relates to a motorized cleaning implement for cleaning a surface comprising a bumper pad for retaining a cleaning substrate, a motor for causing the bumper pad to move relative to the motor in a reciprocating motion, wherein the motor is operably connected to the bumper pad and a disposable cleaning substrate removably connected to at least a portion of the bumper pad.

In one embodiment, the invention also relates to a method of cleaning a surface with a motorized cleaning implement having a bumper pad for retaining a cleaning substrate and a motor for causing the bumper pad to move relative to the motor in a reciprocating motion, the method comprising providing a cleaning substrate, attaching said cleaning substrate to at least a portion of said bumper pad and contacting a surface to be cleaned with said cleaning substrate.

BRIEF DESCRIPTION OF THE DRAWINGS

While the specification concludes with claims particularly pointing out and distinctly claiming the invention, it is believed that the present invention will be better understood from the following description taken in conjunction with the accompanying drawings in which:

FIG. 3 is an enlarged view of the mop head of the cleaning implement shown in FIG. 2;

FIG. 6A is an isometric view of another cleaning implement of the present invention;

FIG. 6B is a top view of another cleaning implement of the present invention;

FIG. 7 is a top view of the cleaning implement of FIG. 6A;

FIG. 9 is an isometric view of another cleaning implement of the present invention;

FIG. 11 is an isometric view of another cleaning implement of the present invention;

FIG. 12 is a top view of a cleaning implement and a disposable cleaning substrate located underneath the bumper pad of the implement;

FIG. 13 is a top view of the implement of FIG. 12 where the cleaning substrate is attached to the bumper pad;

DETAILED DESCRIPTION OF THE PREFERRED EMBODIMENTS

While not intending to limit the utility of the cleaning implement and substrate herein, it is believed that a brief description of its use will help elucidate the invention.

Figure 1:
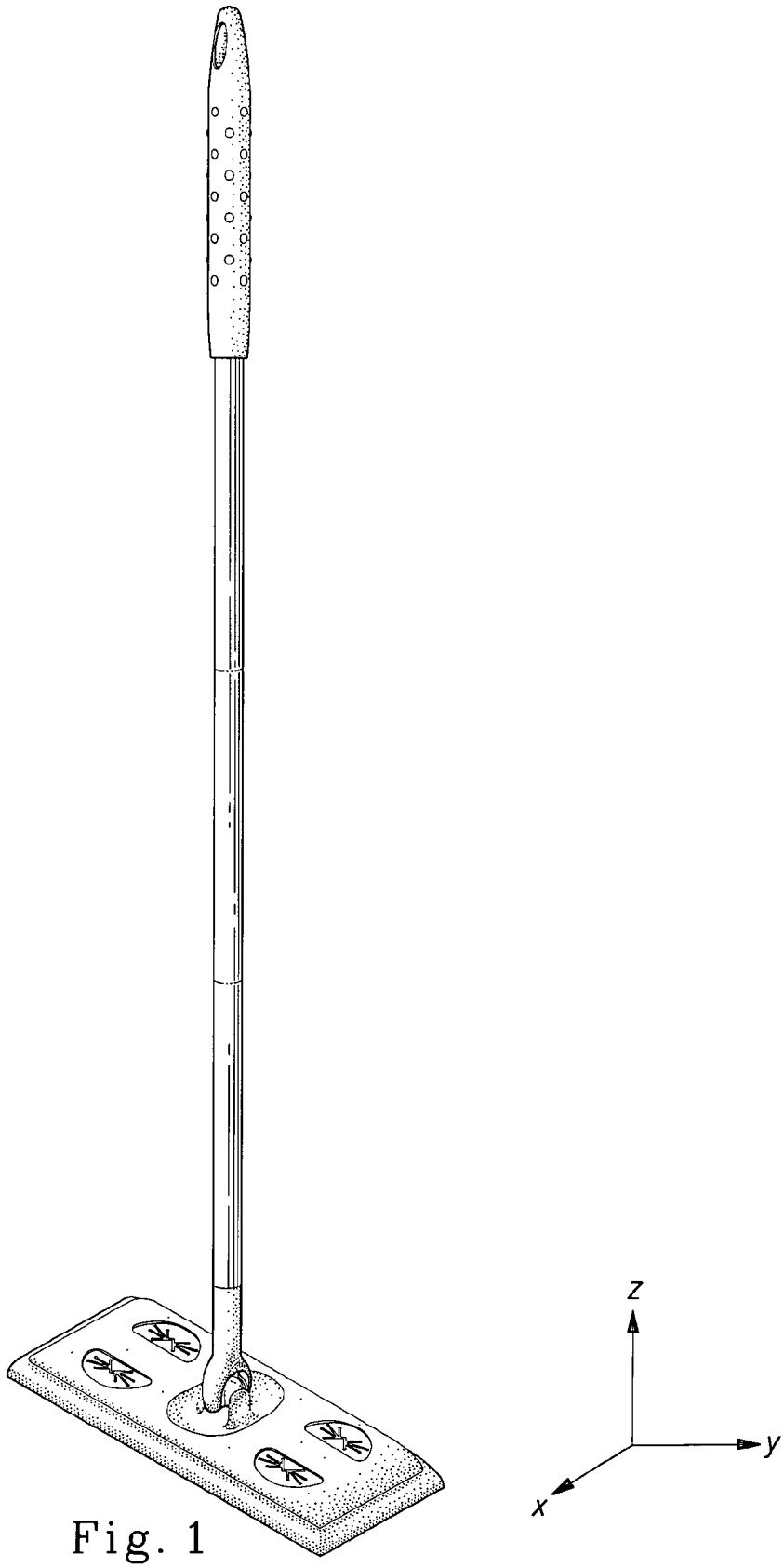
FIG. 1 is an isometric view of a "traditional" cleaning implement.

Modern cleaning implements employ disposable cleaning substrates such as sheets or absorbent pads, which are releasably affixed to the head of the cleaning implement, and which can conveniently be discarded and replaced after soiling. These cleaning implements have a handle which is rotatably connected to a mop head. The mop head of these is substantially rectangular and includes a rigid support plate which is connected to the handle, as well as, a "bumper" pad attached to the bottom surface of the mop head. This bumper pad, which is made of a flexible material, minimizes the risk that the surface might be damaged during the cleaning operation. The cleaning substrate is wrapped around the mop head and attached to slitted structures located on top of the support plate. One example of such a "modern" cleaning implement is the SWIFFER® cleaning implement sold by The Procter & Gamble Company and is shown is FIG. 1. This type of implement is particularly adapted to clean large flat surfaces such as floors, walls or ceilings. However, the size, the shape as well as the rigidity of the mop head, does not allow a user to clean other type of surfaces such as sinks or bathtubs, or "narrow" surfaces such as the floor between a wall and a toilet seat.

In order to clean curved and/or narrow surfaces, a user can apply a cleaning solution directly on the surface without wiping it off the surface. However, better cleaning results are obtained when the surface is wiped with a cleaning substrate. A user can apply a cleaning solution onto a cleaning substrate or onto the surface and then wipe the surface with this cleaning substrate. The most common cleaning substrates are absorbent sponges which are deformable and, as a result, conform to curved surfaces. However, these conventional sponges require that the user wears plastic gloves to avoid contact with the cleaning solution and/or the dirt which is absorbed in the sponge. The effort required from a user in order to remove tough stains, renders the cleaning task difficult and inconvenient. In addition, since these sponges are intended to be reusable, after repeated usage, the sponge itself becomes dirty, unsanitary or unsightly.

The foregoing considerations are addressed by the present invention, as will be clear from the detailed disclosures which follow.

All documents cited herein are, in relevant part, incorporated herein by reference; the citation of any document is not to be construed as an admission that it is prior art with respect to the present invention.

It should be understood that every maximum numerical limitation given throughout this specification will include every lower numerical limitation, as if such lower numerical limitations were expressly written herein. Every minimum numerical limitation given throughout this specification will include every higher numerical limitation, as if such higher numerical limitations were expressly written herein. Every numerical range given throughout this specification will include every narrower numerical range that falls within such broader numerical range, as if such narrower numerical ranges were all expressly written herein.

All parts, ratios, and percentages herein, in the Specification, Examples, and claims, are by weight, unless otherwise stated, and all numerical limits are used with the normal degree of accuracy afforded by the art, unless otherwise specified.

As discussed more fully hereafter, the present invention is, in its most preferred form, directed to a cleaning implement having a mop head, which is at least partially deformable, and a disposable cleaning substrate which can be affixed about the mop head during the cleaning operation.

I. Non-Motorized Cleaning Implement

Figure 2:
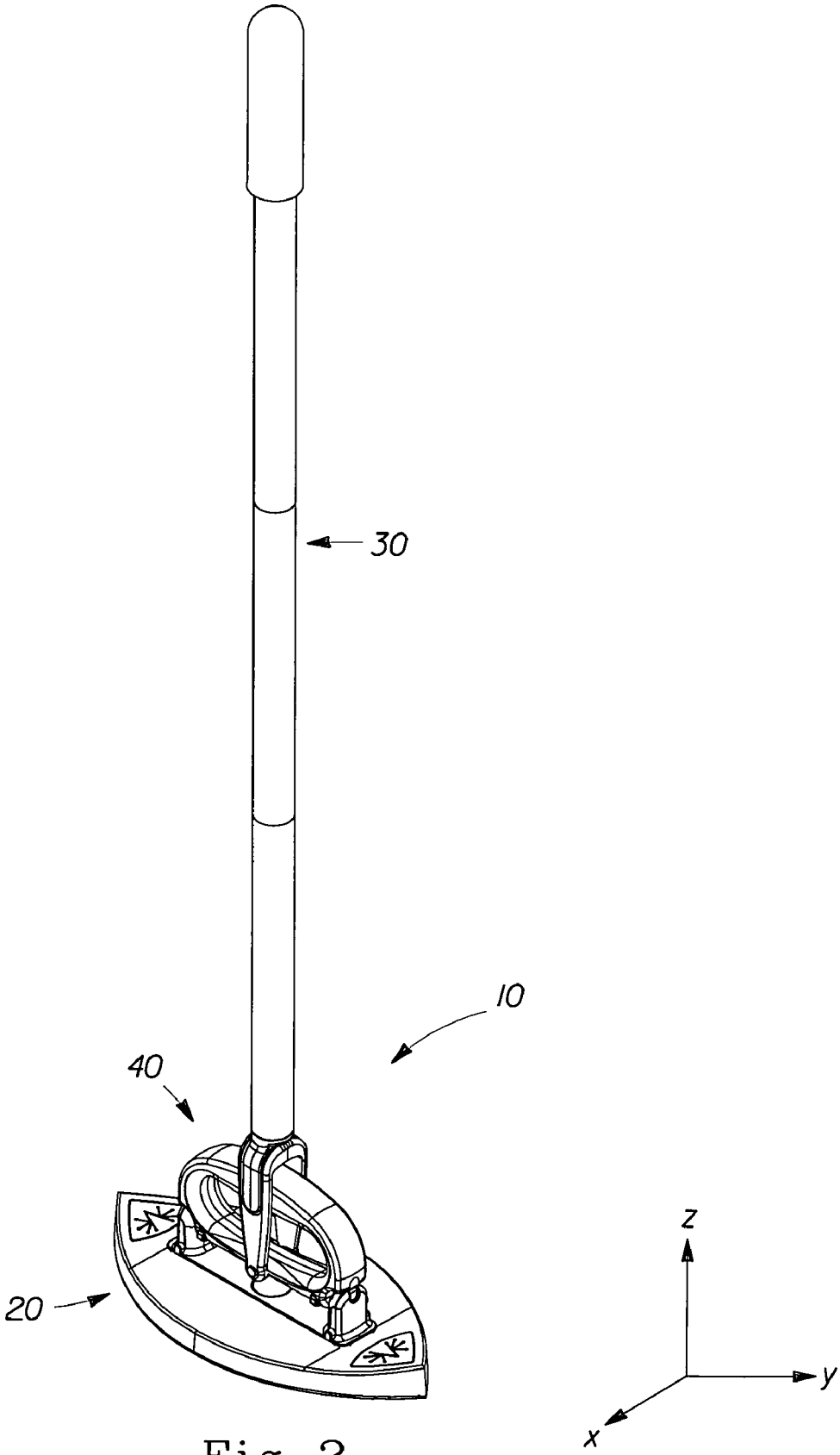
FIG. 2 is an isometric view of a cleaning implement of one embodiment of the present invention.

Referring to FIG. 2, a non-motorized cleaning implement 10 made in accordance with the present invention is illustrated.

In one embodiment, the cleaning implement 10 comprises a mop head 20, a handle 30, which is rotatably connected to the mop head 20 by a universal joint 40 having a first rotational axis A-A and a second rotational axis B-B. By "elongated handle", it is meant a handle whose length is at least about 5 cm, preferably at least about 20 cm, more preferably at least about 60 cm, and even more preferably at least 115 cm.

FIG. 3 shows an enlarged view of the mop head 20, the universal joint 40 and the lower portion of the handle 30.

In one embodiment, the mop head 20 comprises a "bumper" pad 120 connected to an interconnecting member 220. The interconnecting member 220 can be attached to the bumper pad 120 via any method known in the art. In a preferred embodiment, the interconnecting member 220 is adhesively attached to the bumper pad 120. The interconnecting member 220 includes a base portion 1220 and at least one, but preferably two projection portions 2220 and 3220 for pivotably connecting the universal joint 40 to the interconnecting member 220. In a preferred embodiment, the bumper pad 120 is substantially deformable and the base portion is substantially rigid.

Figure 4:
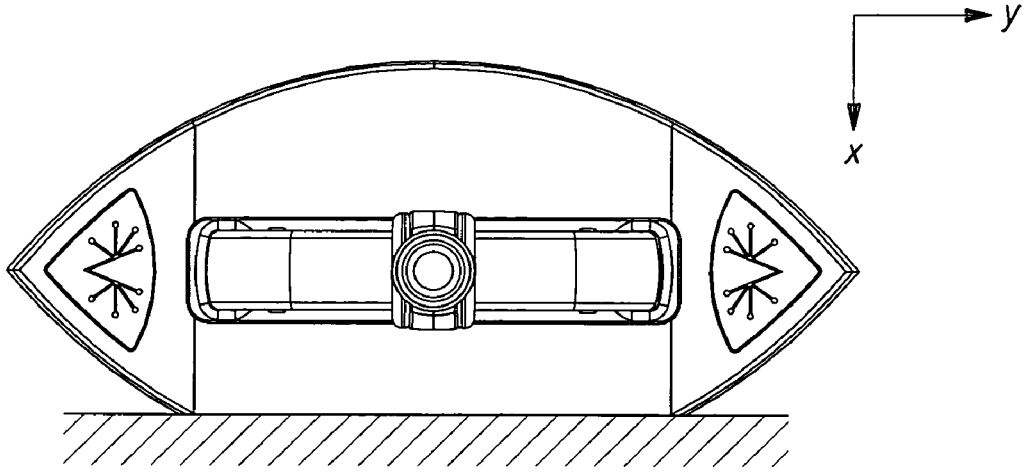
FIG. 4 is top view of the mop head having a bumper pad deformed within the X-Y plane.
Figure 5:
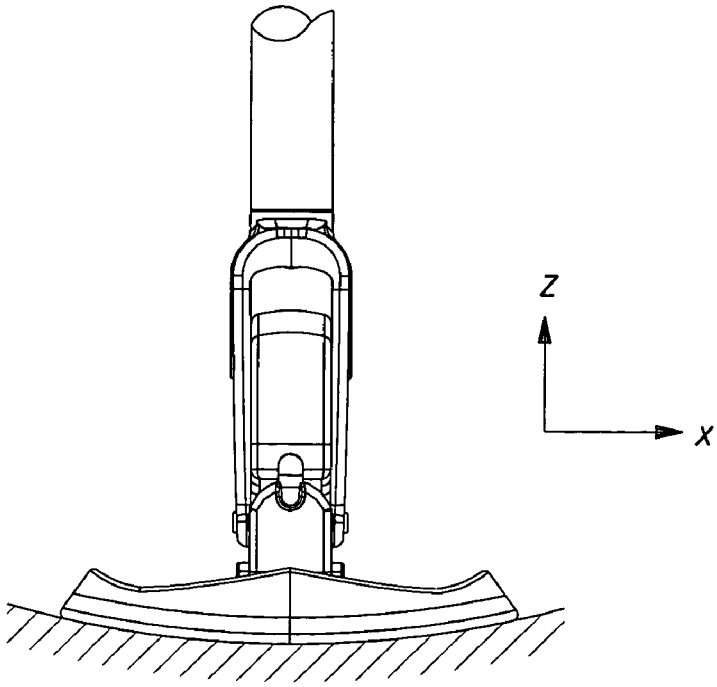
FIG. 5 is a side view of the mop head having a bumper pad deformed in the Z direction.

By "substantially deformable", it is meant that the bumper pad 120 is either deformed or "crushed" in the X-Y plane (i.e. horizontal plane) when the side of the bumper pad is pressed against a wall as shown in FIG. 4, or that the bumper pad 120 is deformed in the Z direction when the bumper pad is pressed against a curved surface such that at least a portion of the bumper pad is bent upward as shown in FIG. 5. In a preferred embodiment, the bumper pad is deformable both in the X-Y plane and in the Z direction. Among other benefits, a deformable bumper pad has the ability to conform to curved surfaces such as sinks or bathtubs and/or the ability to be crushed between two hard surfaces such as between a wall and a toilet seat. Consequently, a cleaning implement with such a deformable bumper pad can be used in combination with a disposable cleaning substrate to clean various hard surfaces found in bathrooms.

In one embodiment, the mop head has a "Rigid to Deformable" ratio of at least about 0.1, preferably at least about 0.15, more preferably at least about 0.2, even more preferably at least about 0.25 and most preferably at least about 0.3. In one embodiment, the "Rigid to Deformable" ratio of the mop head is less than about 0.75, preferably at less than about 0.7, more preferably less than about 0.65, even more preferably less than about 0.6 and most preferably less than about 0.55.

Without intending to be bound by any theory, it is believed that the "Rigid to Deformable" ratio provides an effective measure of the ability of the mop head to conform to the surface being cleaned.

The "Rigid to Deformable ratio" of the mop head can be calculated by dividing the total area of the bottom surface of the base portion 1220 (which is made of a substantially rigid material and which is in contact with the bumper pad) projected in the X-Y plane, by the total area of the bottom surface of the deformable bumper pad projected in the X-Y plane. Since the force applied by a user to the handle 30 and/or the universal joint 40 is transmitted to the bumper pad via the base portion, one skilled in the art will understand that if the "Rigid to Deformable" ratio is too low (i.e. less than about 0.05) this force is applied over a relatively small area of the bumper pad rather than uniformly. Such a low "Rigid to Deformable" ratio reduces the maneuverability of the mop head, it limits the user's ability to control the direction of the mop head, it can potentially result in the bumper pad being damaged and it lowers the overall cleaning efficacy of the implement used in combination with a cleaning substrate attached to the bumper pad. One skilled in the art will also understand that if the "Rigid to Deformable" ratio is too high (i.e. more than about 0.75), the ability of the bumper pad to deform in the X-Y plane as well as in the Z direction is then limited by the rigidity of the base portion in contact with the bumper pad.

In a preferred embodiment, the total area of the bottom surface of the base portion 1220 projected in the X-Y plane is between about 1 $cm^2$ and about 100 $cm^2$, preferably between about 2 $cm^2$ and about 50 $cm^2$, more preferably between about 4 $cm^2$ and about 30 $cm^2$. The base portion 1220 can have any suitable geometric shape. One skilled in the art will understand that the base portion can be segmented resulting in a plurality of base portions and still provide the same benefits.

In a preferred embodiment, the total area of the bottom surface of the deformable bumper pad projected in the X-Y plane is between about 2 $cm^2$ and about 500 $cm^2$, preferably between about 4 $cm^2$ and about 400 $cm^2$, more preferably between about 6 $cm^2$ and about 300 $cm^2$.

In one embodiment, the interconnecting member 220 is attached to the bumper pad 120 along the longitudinal axis L-L. In a preferred embodiment, the length of the interconnecting member 220 measured along the longitudinal axis L-L of the bumper pad 120 is at least about 20%, preferably between about 20% and about 85%, more preferably between about 35% and about 75% of the length of the bumper pad measured along the longitudinal axis L-L. In one embodiment, the width of the interconnecting member 220 measured along a line perpendicular to the longitudinal axis L-L of the bumper pad 120 is between about 10% and about 60%, preferably between 15% and about 50%, more preferably between about 20% and about 40% of the width of the bumper pad measured along a line perpendicular to the longitudinal axis L-L.

In one embodiment the bumper pad is made of a deformable material having a type A durometer of at least about 5, preferably at least about 7, more preferably at least about 10. In one embodiment the bumper pad is made of a deformable material having a type A durometer of less than about 60 and preferably less than about and more preferably less than about 40 as measured by type A durometer hardness testers. The hardness or durometer ca be measured via a model 408 type A durometer available from Pacific Transducer Corp, from Los Angeles, Calif. and conforms to ASTM D2240. A bumper pad having a "low hardness" allows the bumper pad to conform to the contours and grooves in a surface such as grout lines between tiles in a bathroom as well as the curves in a tub or shower stall. In contrast, a bumper pad made from a conventional thermoplastic or stiff foam having a type A durometer greater than about 60, tends not to conform easily to the shape of fine details such as grout lines between tiles. A bumper pad with a type A durometer of less than about 5 will typically be too flimsy and does not have the stiffness needed to effectively clean a surface. This type of bumper pad with type A durometer less than about 60 but greater than about 5 is very conformable and can be used in combination with a stiffening member (described infra) to prevent the bumper pad from losing it's shape and to prevent it from contacting the lower edge of a housing during use and heavy scrubbing.

In one embodiment, the thickness of the bumper pad (i.e. in the Z direction) is at least about 2 mm, preferably at least about 5 mm, more preferably at least about 10 mm, and even more preferably at least about 15 mm. In one embodiment, the thickness of the bumper pad (i.e. in the Z direction) is less than about 100 mm, preferably less than about 80 mm, more preferably less than about 50 mm. One skilled in the art will understand that for a given hardness or durometer, the ability of a material to deform is inversely proportional to its thickness. In other words, a relatively thin bumper pad made of a deformable material will tend to deform more than a thicker bumper pad made of the same material.

In one embodiment, the bumper pad 120 comprises "weaknesses" for facilitating the deformation of the bumper pad. By "weaknesses for facilitating the deformation of the bumper pad" it is meant any alteration made to or formed within the bumper pad material in order to increase its ability to deform in the X-Y plane and/or in the Z direction. Non-limiting examples of such "weaknesses" include slits made on a portion of the bumper pad, slits made through the whole thickness of the bumper pad, bubbles or voids created within the bumper pad, cavities made on the top and/or bottom surface of the bumper pad, holes or openings extending through the entire thickness of the bumper pad and any combination thereof. In one embodiment, these weaknesses are uniformly located on the bumper pad in order to increase the ability of the pad to deform uniformly. In a preferred embodiment shown in FIG. 6A, these weaknesses are "concentrated" in the portion the bumper pad 120 located between the outer edges of the bumper pad 120 and the longitudinal side edges of the base portion 1220. One skilled in the art will understand that depending on the location, number and/or size of the weaknesses, it becomes possible to enhance the aptitude of specific portions of the bumper pad to deform under pressure or constraints In a preferred embodiment, the bumper pad 120 includes at least one but preferably a plurality of weaknesses which are holes or openings 1120 made or formed through the whole thickness of the bumper pad. Among other benefits, these holes 1120 facilitate the deformation of the bumper pad 120 in the X-Y plane and in the Z direction. In one embodiment, a bumper pad 120 comprises between 1 and 50 holes, preferably between 2 and 30 holes, more preferably between 6 and 20 holes. The holes or openings 1120 can have any geometric shape know in the art such as circular, rectangular, triangular, oval, longitudinal, curved inwardly or outwardly relative to the center of the bumper pad and still provide the same benefits. FIG. 6B shows an example of a bumper pad 120 including four longitudinal opening 1125 curved inwardly. In addition to increasing the aptitude of the bumper pad to deform, the holes or openings 1120 also help to drain liquids through the bumper pad when the bumper pad is rinsed under a stream of water.

In a preferred embodiment, the bumper pad 120 is made of a substantially nonabsorbent material. By "substantially nonabsorbent material", it is meant that the weight of water absorbed into an originally dry bumper pad, and after 5 minutes of full immersion in water without undue deformation or squeezing of the bumper pad, is less than about 50% of the weight of the dry bumper pad, preferably less than about 30%, more preferably less than about 20%, even more preferably less than about 10% and most preferably less than about 2% of the weight of the dry bumper pad. Among other benefits, since the cleaning implement is used with a disposable cleaning substrate, the majority of the dirt removed from the surface being cleaned is trapped into the disposable substrate. As a result, only a residual amount of dirty solution is left of the nonabsorbent bumper pad after the cleaning operation, and this residual amount can easily be rinsed off with water. Consequently, the cleaning implement provides a hygienic/sanitary way to clean surfaces as opposed to conventional sponges.

The bumper pad 120 can have any suitable geometric shape. In one embodiment shown in FIG. 6, the bumper pad 120 has an elliptical shape. In a preferred embodiment, the bumper pad 120 is gradually tapered from the middle portion towards two tips 2120 and 3120 and has substantially an "eye" shape or an acute shape.

In one embodiment represented in FIG. 7 where the handle and the upper member of the universal joint are not shown for clarity, the two edges of the bumper pad forming the tip 2120 define an angle $\alpha$ which is between about 10 degrees and about 150 degrees, preferably between about 40 degrees and about 120 degrees and more preferably between about 60 degrees and about 100 degrees. In one embodiment, the two edges of the bumper pad forming the tip 3120 define an angle $\beta$ which is between about 1.0 degrees and about 150 degrees, preferably between about 40 degrees and about 120 degrees and more preferably between about 60 degrees and about 100 degrees. In one embodiment, the angles $\alpha$ and $\beta$ are different. In a preferred embodiment, the angle $\alpha$ is equal to the angle $\beta$. Among other benefits, each of the tips 2120 and 3120 allows a cleaning substrate attached to the mop head 20 and the bumper pad 120 to clean surfaces in corners of a room by allowing a user to maneuver the cleaning substrate within the corner. In addition, either of the tips 2120 or 3120 allows the mop head to reach and clean narrow surfaces located in between vertical surfaces, for example in between a wall and a toilet seat, when either one of the tips is inserted progressively between the vertical surfaces. It can be also appreciated that in the event the distance separating the vertical surfaces is less than the width of the bumper pad, the ability of the bumper pad to be deformed or "crushed" within the X-Y plane allows the mop head to be pushed even further and, consequently, clean more of this narrow floor surface.

In one embodiment, the thickness of the bumper pad is constant.

Figure 8A:
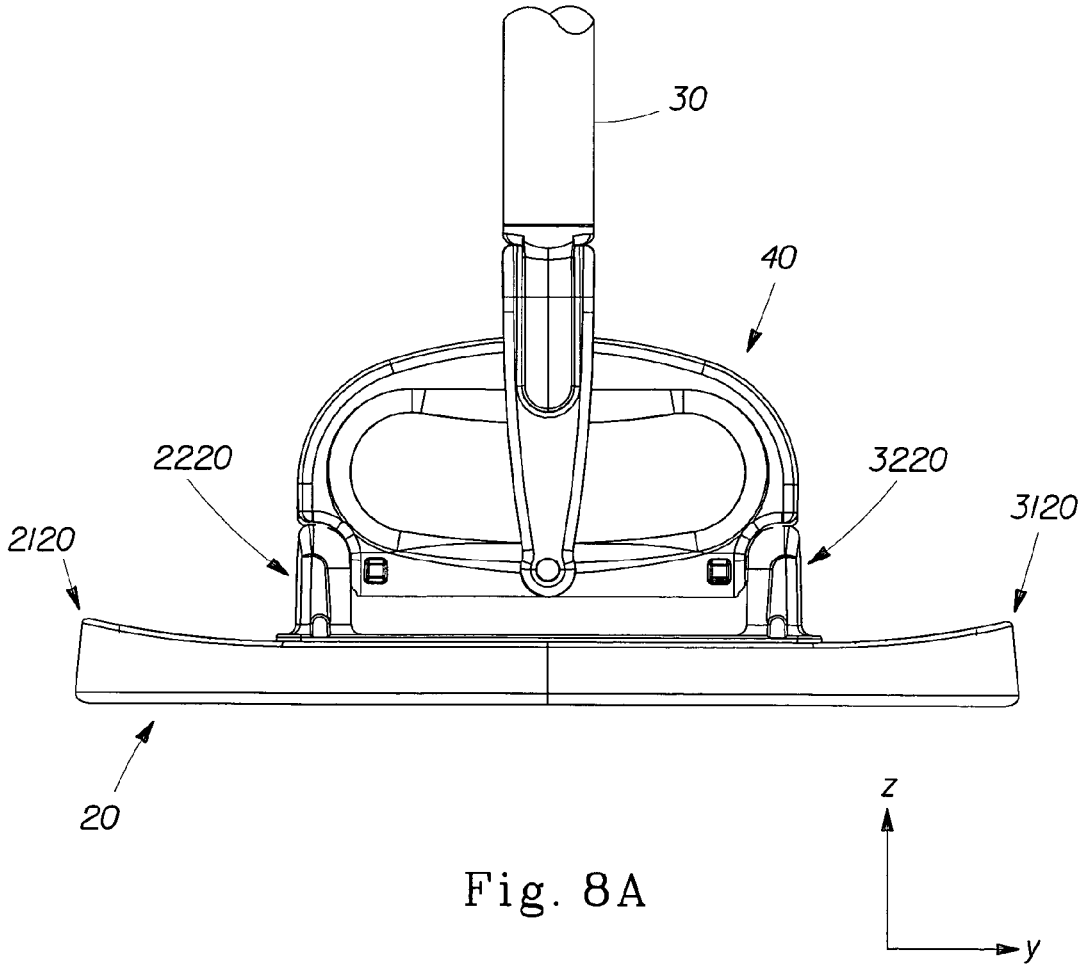
FIG. 8A is a front view of another cleaning implement having a curved top surface.

In a one embodiment shown in FIG. 8A, the thickness of the bumper pad 120 varies within the X-Y plane and preferably varies along the Y direction. In a preferred embodiment, the bottom surface of the bumper pad 120 is substantially flat and its thickness increases from the middle portion of the bumper pad towards at least one but preferably both tips 2120 and 3120. In a preferred embodiment, the thickness of the bumper pad 120 is constant at the portion of the pad adjacent to the interconnecting member 220 and then increases from the edges of the projection portions 2220 and 3220 towards the tips 2120 and 3120. As a result, the top surface of the bumper pad is curved at the portions of the pad adjacent to the tips 2120 and 3120. In another embodiment, the top surface of the bumper pad 120 can be substantially flat and the bottom surface of the bumper pad can be curved at the portions of the pad adjacent to the tips 2120 and 3120.

Figure 8B:
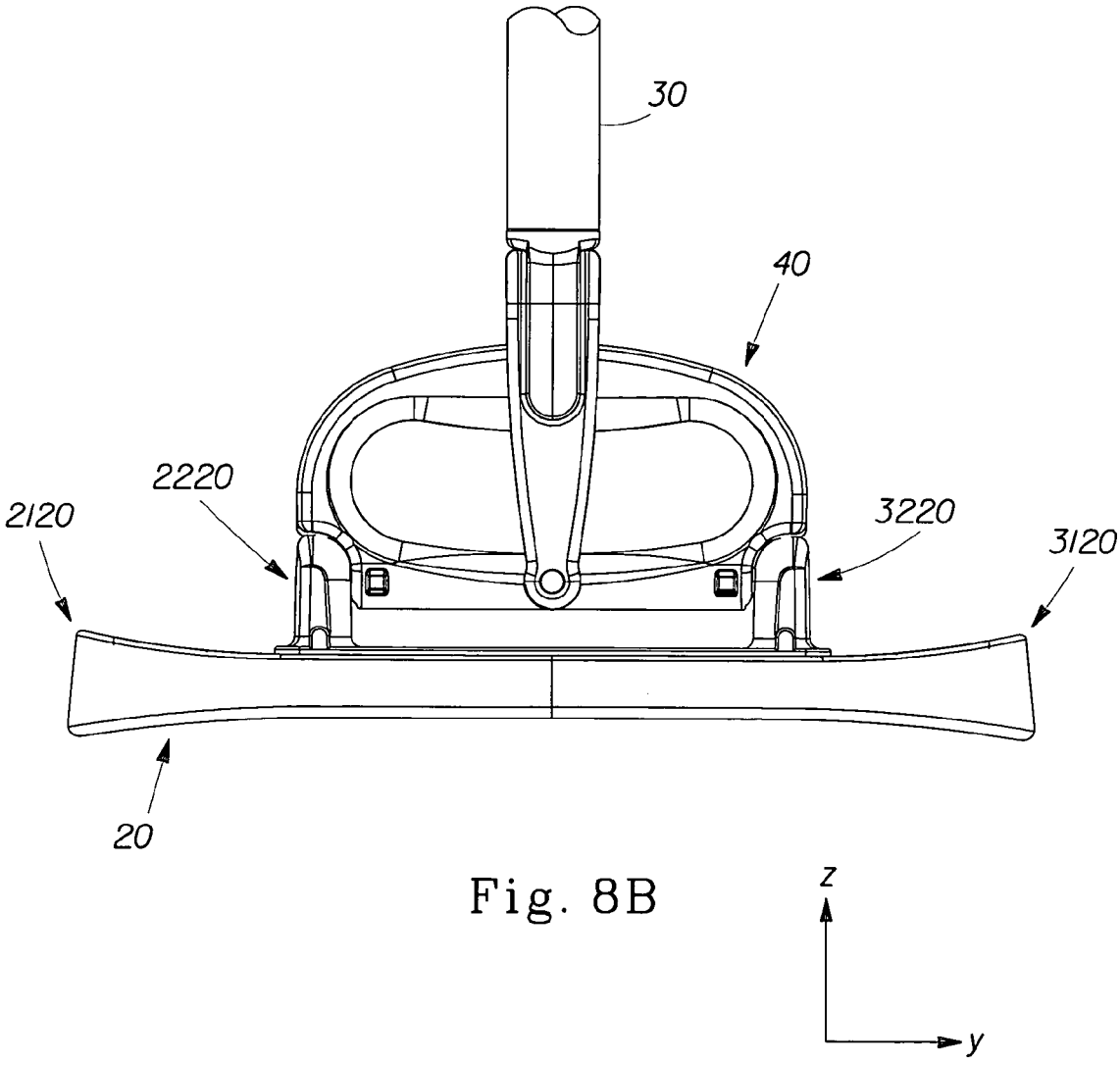
FIG. 8B is a front view of another cleaning implement having curved top and bottom surfaces.

In yet another embodiment shown in FIG. 8B, both the top and bottom surfaces of the bumper pad 120 can be curved at the portions of the pad adjacent to the tips 2120 and 3120. Without intending to be bound by any theory, it is believed that when a cleaning substrate is attached to the bumper pad having a curved bottom surface, and the mop head is applied against a surface to be cleaned, the ability of the bumper pad to deform under pressure allows the cleaning substrate to be put under tension. As a result, the cleaning substrate is tightly held on the bumper pad.

In addition, the thickness of the bumper pad can impact its ability to deform. Consequently, it is possible to create zones with increased rigidity (or reduced deformability) on the bumper pad by providing a bumper pad with a gradually increasing or decreasing thickness. Among other benefits, a bumper pad with increased thickness toward the tips 1120 and 2120, improves the ability of the mop head to remove tough stains as discussed hereinafter.

In one embodiment represented in FIG. 9, the base portion 1220 is connected to the bumper pad 120 such that at least one of the rotational axis of the universal joint 40 is substantially parallel to the line L-L joining the tips 2120 and 3120. In one embodiment, the universal joint 40 comprises a lower member 140 which is rotatably connected to the projection portions 2220 and 3220 of the base portion 1220 about a rotational axis A-A. The universal joint 40 also includes an upper member 240 which is rotatably connected to the lower member 140 about a rotational axis B-B. In a preferred embodiment, the distal end of the handle 30 is releasably connected to the upper member 240.

In one embodiment, the lower member 140 forms a hand-grip that a user can hold with one hand. Among other benefits, this embodiment allows a user to clean large surfaces (such as floors, bathtubs) or surfaces which are hard to reach (such as walls) by using the mop head 20 in combination with the elongated handle 30, but it also allows a user to clean smaller surfaces (such as mirrors) or surfaces which are easy to reach (such as a sink) without the elongated handle 30 by simply holding the hand-grip with one hand and then wipe the surface.

Figure 10:
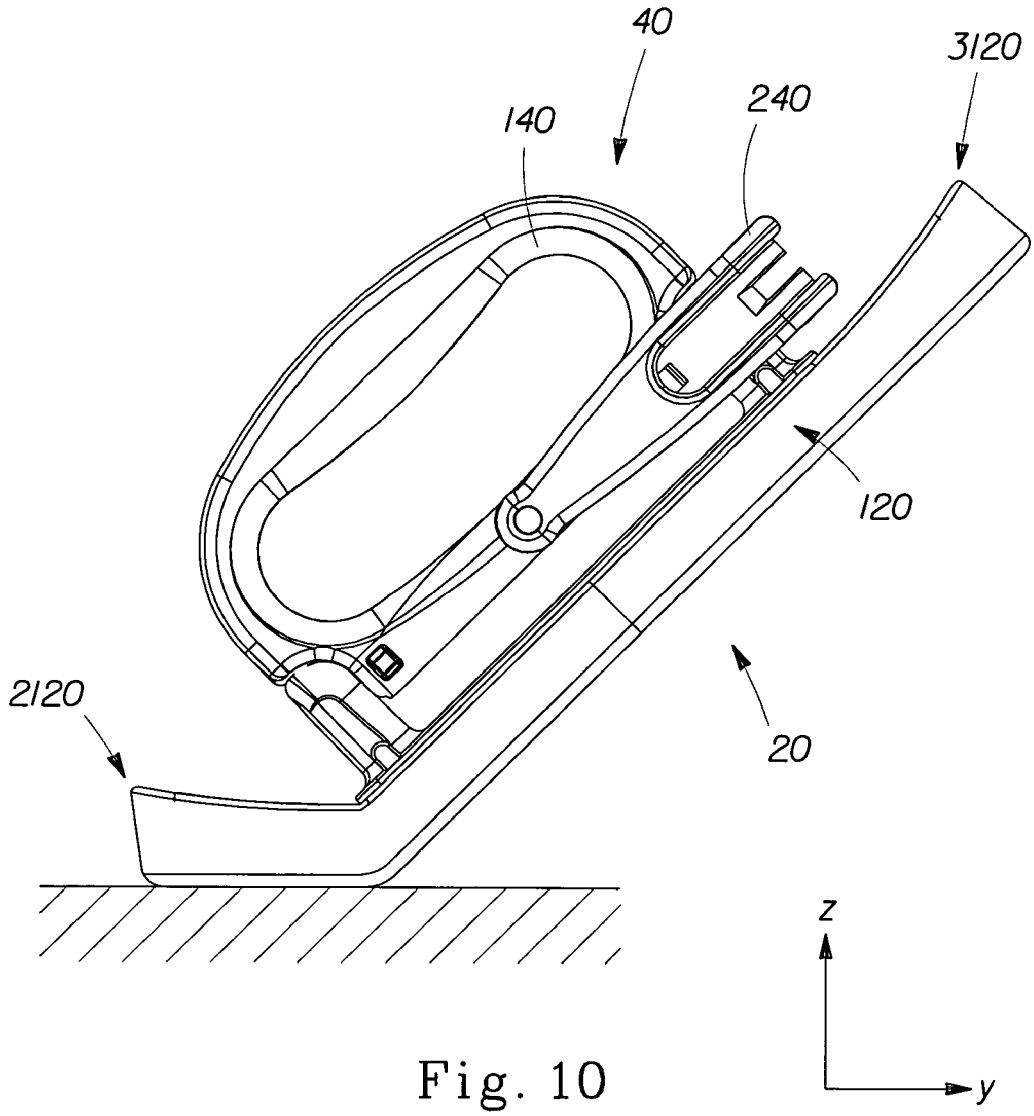
FIG. 10 is a front view of the cleaning implement of FIG. 9 shown during a cleaning operation.

In an even preferred embodiment, the base portion 1220 is connected to the bumper pad 120 such that the rotational axis A-A of the lower member 140 is substantially parallel with the line L-L joining the tips 2120 and 3120. Among other benefits, this embodiment allows a user, who is holding the hand-grip with one hand, to "concentrate" the force he or she applies onto the grip in a region adjacent to one of the tips 2120 or 3120 by bending the bumper pad 120 such that only this region of the bumper pad adjacent to the tip is in contact with the surface to be cleaned as shown in FIG. 10. One skilled in the art will understand that concentrating the force towards a tip helps remove tough stains by increasing the frictional forces between the cleaning substrate and the stain.

In a preferred embodiment represented in FIGS. 10 and 11, a user can temporarily lock the lower member 140 (i.e., prevent rotation of the lower member 140 about the rotational axis A-A) by rotating the upper member 240 until one of the projection portions 2220 or 3220 is located in between the legs portions 1240 and 2240 of the upper member 240. Among other benefits, this embodiment prevents the mop head to tilt or rotate while a user holds the hand-grip with one hand.

In an even preferred embodiment, the length of at least one but preferably both projections portions 2220 and/or 3220 is slightly greater than the inner distance between the first and second leg portions 1240 and 2240 of the upper member 240 such that a user can temporarily lock the universal joint 40 (i.e., prevent rotation of both the lower member 140 and the upper member 240) by forcing or pushing the upper member 240 against one of the projection portions. Among other benefits, this embodiment prevents the upper member 240 from rotating while the user's fingers are within the "path" of the upper member 240 and minimizes the risk that his or her fingers might be pinched accidentally. A preferred example of such a lockable universal joint is described in copending U.S. patent application Ser. No. 60/499,852 to James et al. filed Sep. 3, 2003, and n copending U.S. patent application Ser. No. 60/562,000 to James et al. filed Apr. 13, 2004, both assigned to The Procter & Gamble Company As previously discussed, the cleaning implement 10 is used with a disposable cleaning substrate which is releasably affixed to the mop head 20.

In one embodiment, the mop head 20 comprises at least one retaining member for engaging and retaining a disposable cleaning substrate about the mop head 20 during the cleaning operation. Non-limiting examples of suitable retaining members include deformable attachment structures, hook or loop fasteners, clamping device, protrusions, clips, adhesive or any combinations thereof.

In a preferred embodiment shown in FIG. 12, the mop head 20 comprises at least one but preferably two attachment structures 320 and 325 for engaging and retaining a disposable cleaning substrate 50. An attachment structure 320 includes a relatively thin (i.e. less than 2 mm in thickness) and deformable layer of plastic located above a hollow space. This layer of plastic includes intersecting slits made thereof and which form at least one, but preferably a plurality of triangular or pie shape sections having an apex. Since the pie shape sections are deflectable, a user can push at least a portion of a cleaning substrate past the apex(es) of the pie shape section(s) under normal finger pressure. When the user removes his or her finger, the pie shape sections can then recover their original shape and at least one of the apexes engages (and even preferably pierce) the cleaning substrate which is thereby retained about the mop head. Suitable attachment structures are disclosed in greater details in U.S. Pat. No. 6,305,046 to Kingry et al. issued Oct. 23, 2001, and assigned to The Procter & Gamble Company.

In one embodiment, the mop head 20 comprises at least one but preferably two attachment structures formed within the base portion 1220. In a preferred embodiment, the mop head comprises at least one but preferably two attachment structures 320 and 325 connected to the deformable bumper pad 120 as shown in FIG. 12. In one embodiment, the attachment structure(s) 320 and/or 325 are adjacent to the top surface of the bumper pad 120. In a preferred embodiment, the attachment structure(s) 320 and/or 325 are positioned on the longitudinal axis L-L of the bumper pad. In one embodiment shown in FIG. 12, the distance d between the geometric center Ca of an attachment structure 320 (or any other kind of retaining members) and the tip 2120 measured along the longitudinal axis L-L, is less than about 80%, preferably less than about 60%, more preferably less than 50% and even more preferably less than about 40% of the distance D between the center of the bumper pad Cb and the tip 2120 measured along the longitudinal axis L-L. Among other benefits, the location of the attachment structure(s) 320 and/or 325 on the longitudinal axis L-L allows a user to attach two portions 150 and 250 of a cleaning substrate 50 to a single attachment structure as shown in FIG. 13 by folding and/or wrapping the two portion 150 and 250 on top of the bumper pad 120. The two portions 150 and 250 are respectively symmetrically located relative to the longitudinal axis of the cleaning substrate and are on opposite halves of the cleaning substrate. In addition, the attachment structure(s) 320 and/or 325 located on the longitudinal axis L-L does not affect the deformability of the sides of the bumper pad within the X-Y plane and/or in the Z direction as previously shown in FIGS. 4 and 5. In a preferred embodiment, the attachment structure (s) 3.20 and/or 325 is substantially adjacent to the tip 2120 and/or 3120. By "adjacent to the tip" it is meant that the distance d between the geometric center Ca of an attachment structure 320 (or any other kind of retaining member) and the tip 2120 measured along the longitudinal axis L-L, is less than about 35%, preferably between about 5% and about 30%, more preferably between about 10% and about 25% of the distance D between the center of the bumper pad Cb and the tip 2120 measured along the longitudinal axis L-L. It is found that the location of the attachment structure 320 on the mop head 20 has a direct impact on the minimum dimensions (i.e. length and width) and in particular on the width of a substantially rectangular cleaning substrate that is attached to the bumper pad 120 as shown in FIG. 13. Among other benefits, the attachment structure 320 and/or 325 located adjacent to the tip(s) 2120 and/or 3120 allows the handle 30 to be rotated in any direction without interfering with a disposable cleaning substrate retained by the attachment structure(s). In addition, when the cleaning implement is used with a substantially rectangular cleaning substrate, placing the attachment structures 320 and/or 325 as close as possible from the tips 1120 and/or 2120, the width of the cleaning substrate can be minimized since opposite sections or corners of the cleaning substrate can reach the attachment structure. As a result, less material is required to make the cleaning substrate and the manufacturing cost of the substrate is reduced. In addition, when a disposable cleaning substrate is attached to the mop head as shown in FIG. 13, the cleaning substrate covers the sides of the bumper pad such that both the bottom surface and the side surfaces of the implement can be used to clean.

One skilled in the art will understand that a bumper pad having a rectangular shape and two retaining member located on the bumper pad as previously discussed can be used with a substantially wider cleaning substrate but that this cleaning substrate can interfere with the universal joint and/or the handle. To prevent the cleaning substrate to interfere with the universal joint, a cleaning substrate can have at least one but preferably two slits or notches or cut-outs made on the cleaning substrate such that the universal joint and/or handle are free to rotate without any interference from the cleaning substrate attached to the bumper pad.

In one embodiment, the outer surface of the bumper pad 120 is preferably substantially continuous, and the bumper pad is preferably made of a deformable and nonabsorbent material. By "substantially continuous outer surface", it is meant that the outer surface of the bumper pad is uniform and/or uninterrupted as opposed to, for example, the outer surface of a brush having a plurality of bristles, which together form a discontinuous surface. In one embodiment, the outer surface of the bumper pad can be textured and/or have a three-dimensional pattern formed onto the bumper pad. Non-limiting examples of suitable deformable nonabsorbent materials include ethylene vinyl acetate, SANTOPRENE®, neoprene, KRAYTON, natural rubber, polyethylene, polypropylene rubber, polyurethane, synthetic foam or any other suitable material.

Figure 14:
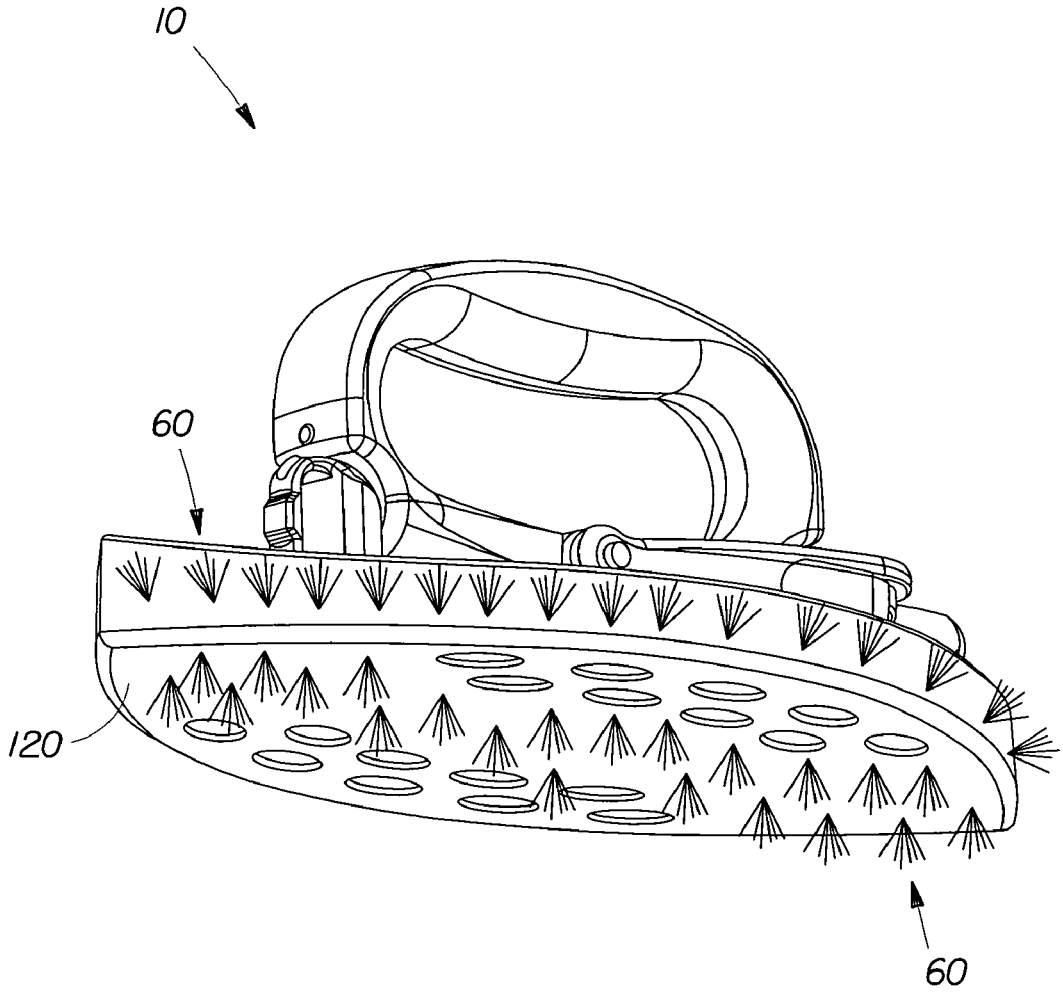
FIG. 14 is an isometric view of an implement of the invention where the bumper pad includes bristles.

In one embodiment, the outer surface of the bumper pad 120 can be substantially continuous as previously discussed, but also include bristles 60 attached to the deformable bumper pad. In a preferred embodiment, the bristles 60 can be attached to the bottom surface of the bumper pad and/or to the side surfaces of the bumper pad as shown in FIG. 14. Bristles 60 can be beneficial to scrub surfaces but also to retain a disposable nonwoven cleaning substrate.

As previously discussed, the interconnecting member 220 and universal joint 40 are preferably made of a substantially rigid material. Non-limiting examples of substantially rigid materials include wood, metal(s), ceramic, glass, plastic such as polypropylene, polyethylene terephthalate, Acrylonitrile Butadiene-Styrene, nylon, acetyl (any acetal homopolymer or copolymer resins), polystyrene, and any combinations thereof.

In a preferred embodiment bumper pad 120 is fixedly connected to the interconnecting member 220. The bumper pad can be fixedly attached via any method known in the art. In a preferred embodiment, the bumper pad 120 is adhesively attached to the interconnecting member 220 with an adhesive such as synthetic water-borne, hotmelt or solvent-borne.

As previously discussed, the attachment structure(s) 320 and/or 325 are preferably made of a substantially flexible material. Non-limiting examples of substantially flexible materials include low density polyethylene or linear low density polyethylene. In a preferred embodiment, the attachment structure(s) 320 and/or 325 is fixedly connected to the bumper pad 120. In a preferred embodiment, the attachment structure 320 is adhesively connected to inner surface of a peripheral rim or ring whose outer surface is adhesively connected to the bumper pad.

As previously discussed, a cleaning implement 10 includes an elongated handle 30. The handle 30 can be any handle known in the art and can be a single piece, segmented, telescopic or collapsible handle.

The described cleaning implements are preferably used with a disposable cleaning substrate. However, one skilled in the art will understand that these implements can also be advantageously used with a reusable substrate material such as a sponge or any other absorbent material. Non-limiting examples of suitable disposable cleaning substrates include "dry cleaning sheets" which are used to remove particulate matters (such as dust, crumbs, hair, lint, allergens) from a surface to be cleaned, "dry absorbent cleaning wipes or pads" which are used for wet cleaning of a surface by applying a cleaning solution and then wiping the surface with the wipe or pad to remove the dirty solution, or "pre-moistened cleaning wipes or pads" which are pre-impregnated with a cleaning composition. The disposable cleaning substrate can comprise a single layer or multiple layers of substrate material. The disposable cleaning substrate is made preferably of a nonwoven material.

II. Motorized Cleaning Implement

Figure 15:
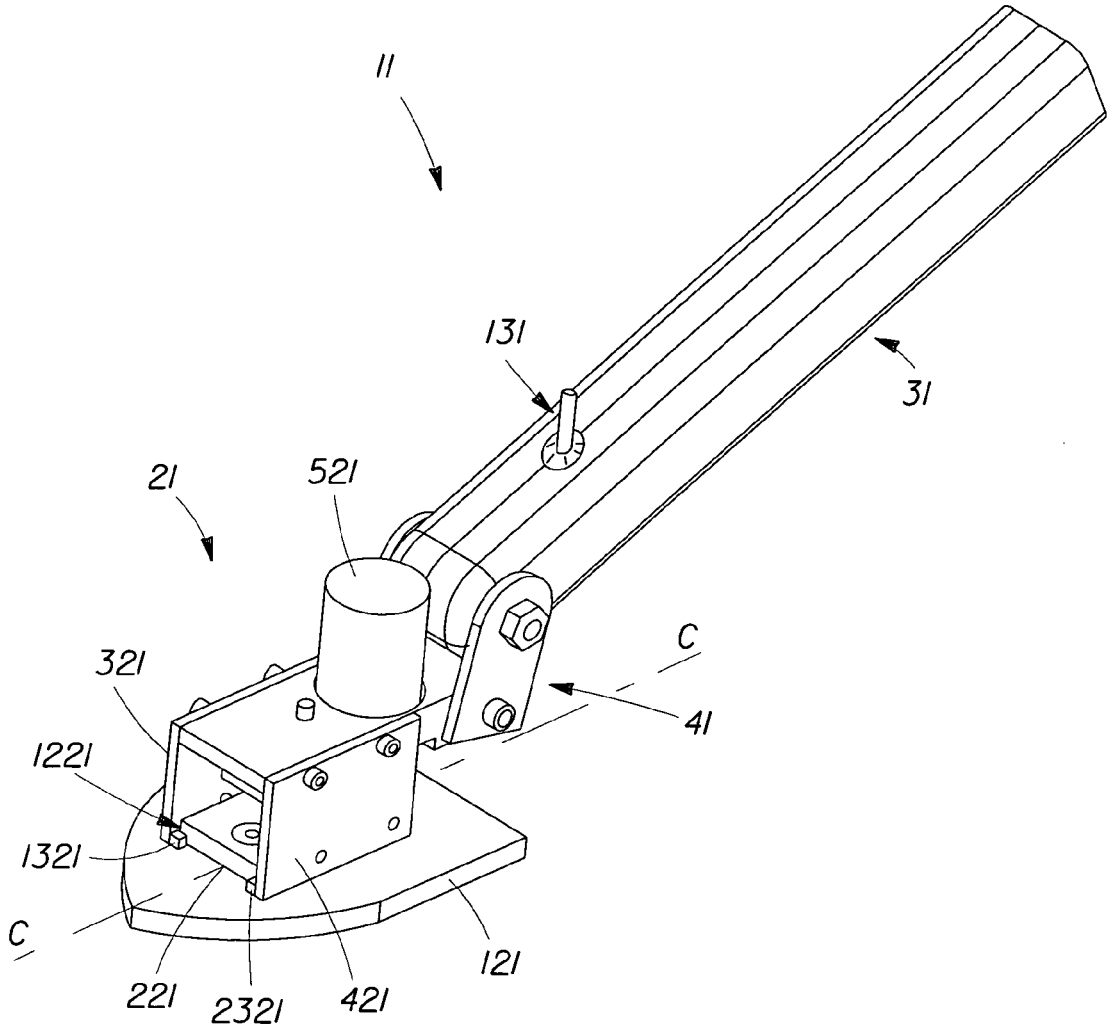
FIG. 15 is an isometric view of a motorized cleaning implement.
Figure 16:
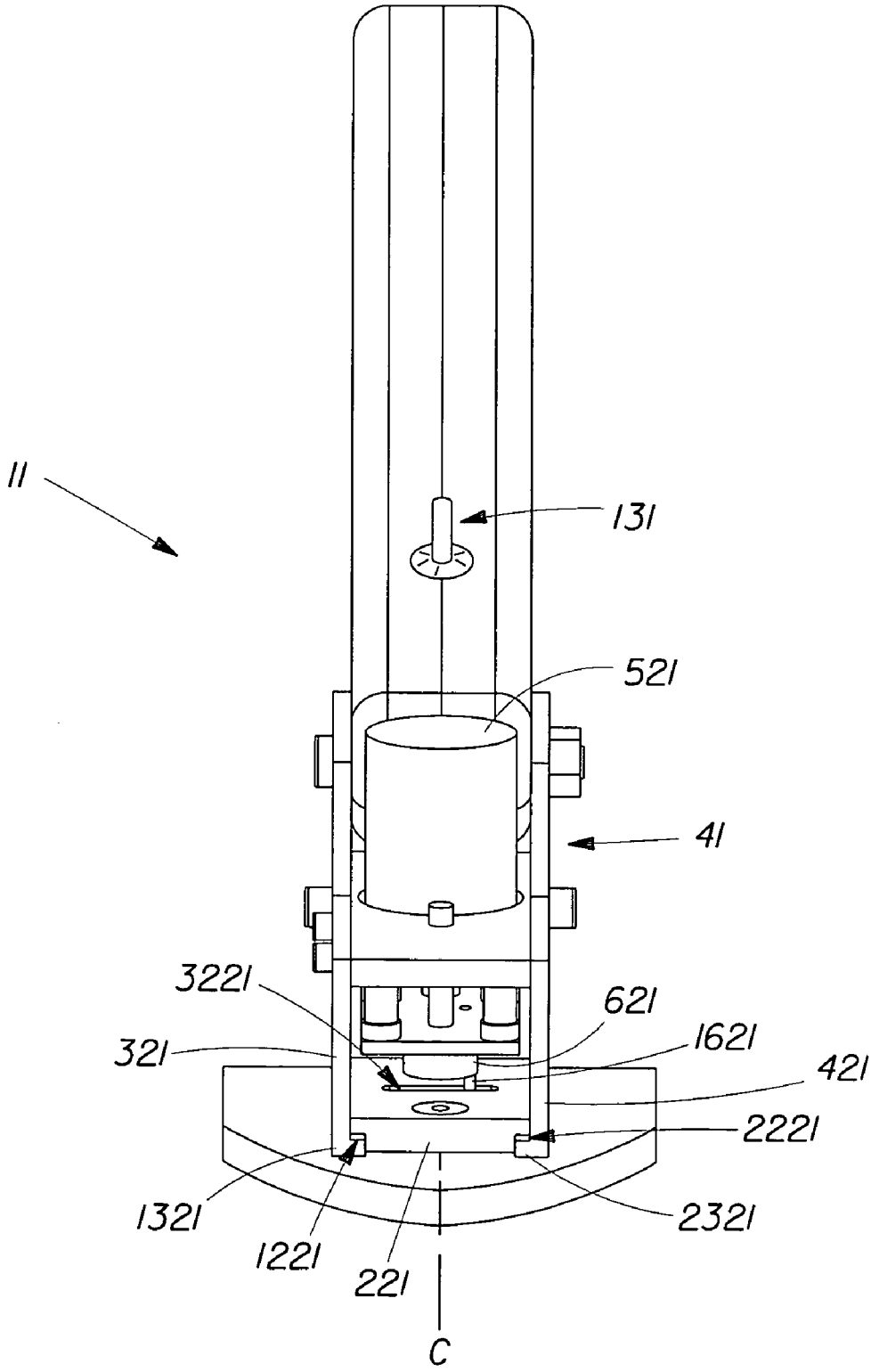
FIG. 16 is a tilted side view of the motorized implement of FIG. 15.

Referring to FIGS. 15 and 16, a motorized cleaning implement 11 made in accordance with one embodiment of the present invention is schematically illustrated.

In one embodiment, the cleaning implement 11 comprises a head 21 and a handle 31, which is connected to the head 21, preferably pivotably connected to the mop head by a joint 41.

In one embodiment, the head 21 comprises a "bumper" pad 121 connected to a sliding member 221. The sliding member 221 can be fixedly attached to the bumper pad 121 via any method known in the art. In a preferred embodiment, the sliding member 221 is adhesively attached to the bumper pad 121.

The bumper pad 121 can be any of the bumper pads previously described in the context of a non-motorized cleaning implement.

In one embodiment, the head 21 has a "Rigid to Deformable" ratio of at least about 0.1, preferably at least about 0.15, more preferably at least about 0.2, even more preferably at least about 0.25 and most preferably at least about 0.3. In one embodiment, the "Rigid to Deformable" ratio of the mop head is less than about 0.75, preferably at less than about 0.7, more preferably less than about 0.65, even more preferably less than about 0.6 and most preferably less than about 0.55.

The "Rigid to Deformable ratio" of the motorized mop head can be calculated by dividing the total area of the bottom surface of the sliding member 221 (which is made of a substantially rigid material and which is in contact with the bumper pad 121) projected in the X-Y plane, by the total area of the bottom surface of the deformable bumper pad 121 projected in the X-Y plane. The sliding member can be either directly connected to the bumper pad or indirectly connected to the bumper pad. A sliding member can be indirectly connected to the bumper pad by being attached to a base portion itself connected to the bumper pad. When the sliding member is connected to a base portion itself connected to the bumper pad, he "Rigid to Deformable ratio" of the motorized mop head can be calculated by dividing the total area of the bottom surface of the base portion (which is made of a substantially rigid material and which is in contact with the bumper pad 121) projected in the X-Y plane, by the total area of the bottom surface of the deformable bumper pad 121 projected in the X-Y plane.

In one embodiment, the sliding member 221 is positioned in between a first and a second guiding member 321 and 421 such that both the bumper pad 121 and the sliding member 221 are moveable, preferably slideably moveable relative to the first and second guiding members 324, 421, along the C-C axis. In one embodiment, at least one but preferably both of the guiding members include a tongue 1321 and 2321 for engaging corresponding grooves 1221 and 2221 made on each side of the sliding member 221 and for allowing the sliding member 221 to slide back and forth along the C-C axis. One skilled in the art will understand that the location of the tongue and grooves can be inverted and still provide the same benefits. One skilled in the art will also understand that mechanisms other than tongue and groove such as for example round, spherical, linear bearings and wheels, can be used and provide the same benefits. In order to minimize friction between the tongue and groove, a low friction material is preferably used and the shape of the tongue and groove is optimized by providing a smooth and/or round surface, in order to limit the contact between the tongue portion and the groove portion In one embodiment, a sliding and/or reciprocating motion is provided to the sliding member 221 by an electric motor 521 connected to the mop head. The motor 521 can be electrically connected to at least one battery (either disposable or rechargeable), which is preferably located within the handle 31. One skilled in the art will understand that since the sliding member is connected to the bumper pad, the sliding and/or reciprocating motion is also communicated to the bumper pad.

The electric motor can be actuated via a switch 131, which is preferably located on the handle 31. The electric motor 521 includes a rotating shaft which is operably connected to the sliding member 221. A non-limiting example of a suitable motor include a Direct Current permanent magnet motor (made by Action Motor, having 6V operating characteristics of 10750 rpm and 0.32 A current draw at no load and $89.10^{-3}$ Nm torque and a 14.5 A current draw at maximum torque which can be used with AA disposable batteries. Non-limiting examples of suitable switches include on-off switch, momentary switch, potentiometer, variable speed switch, and combinations thereof.

In one embodiment shown in FIG. 16, the rotating shaft of the motor 521 is operably connected to the sliding member 221 by a rotating drive 621, which includes a driving pin 1621 orbiting around the rotational axis of the rotating drive 621. In one embodiment, the driving pin 1621 engages a slot 3221 made on the top surface of the sliding member 221 and which is preferably perpendicular to the C-C-axis. One skilled in the art will understand that as the driving pin 1621 orbits around the rotational axis of the rotating drive 621, the pin can navigate within the slot 3221, and as a result, pushes and pull the sliding member 221 and the bumper pad 121 relative to the guiding members 321, 421.

In one embodiment, the sliding frequency of the sliding member and bumper pad is between about 5 Hz and about 50 Hz, preferably between about 10 Hz and about 40 Hz, more preferably between about 1.5 Hz and about 30 Hz. By "sliding frequency" it is meant the number of back and forth motion of the sliding member in one second. One skilled in the art will appreciate that the sliding frequency of the sliding member depends on the rotational speed of the rotating drive 621 and that the amplitude of the sliding member motion, or displacement amplitude, depends on the distance between the driving pin 1621 and the rotational axis of the rotating drive 621. In one embodiment, the displacement amplitude is between 1 mm and 30 mm, preferably between about 2 mm and about 20 mm, more preferably between about 3 mm and about 10 mm.

In one embodiment, the rotating shaft of the electric motor 521 is directly connected to the rotating drive (i.e. the rotational axis of the rotating shaft and the rotating drive are the same. In a preferred embodiment shown in FIGS. 15 and 16, the rotating shaft of the electric motor 521 is indirectly connected to the rotating drive by at least one transmitting gear.

In one embodiment, the rotational axis of the rotating shaft of the motor 521 is substantially parallel to the rotational axis of the rotating drive 621.

Figure 17:
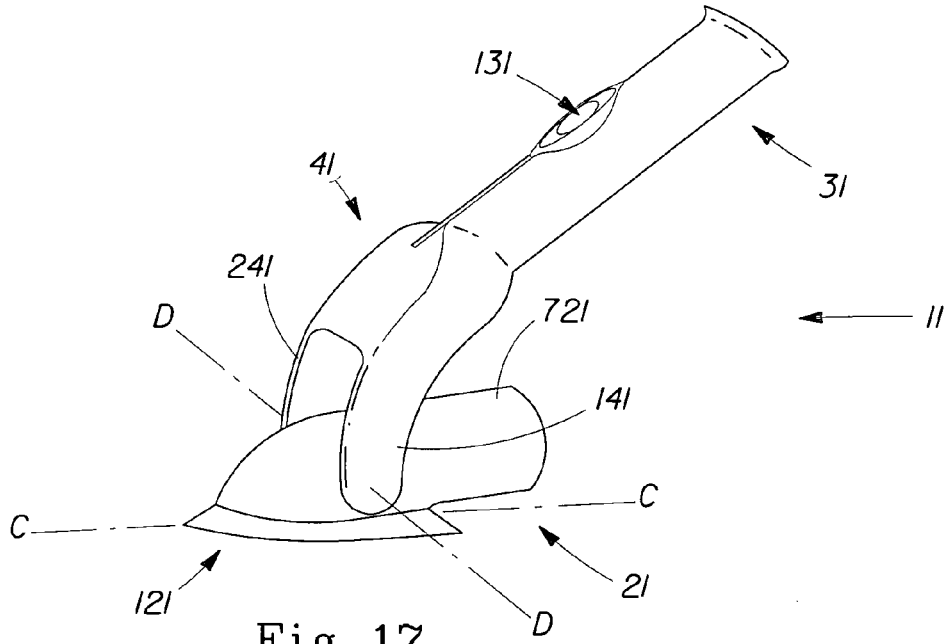
FIG. 17 is an isometric view of another motorized cleaning implement.
Figure 18:
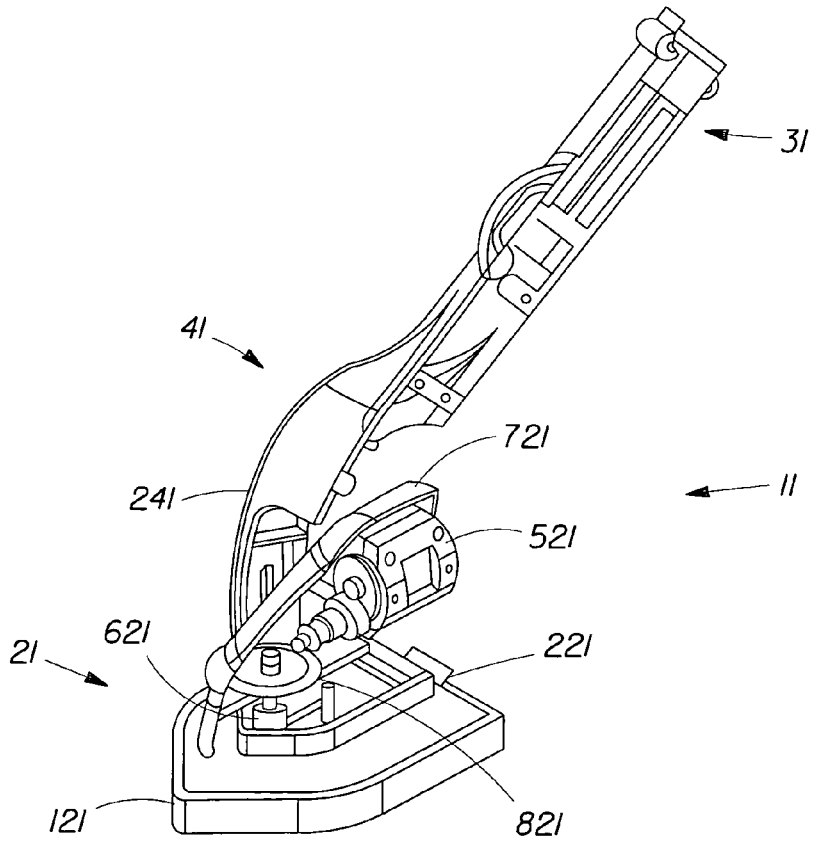
FIG. 18 is an isometric view of the motorized implement of FIG. 16 where part of the mop head housing and handle have been removed.

In a preferred embodiment shown in FIGS. 17 and 18, the rotational axis of the rotating shaft of the motor is substantially perpendicular to the rotational axis of the rotating drive.

FIG. 18 shows the cleaning implement 11 where a portion of the housing 721 containing the motor, the gears and the rotating drive and where a portion of the handle 31 is not shown for clarity. In one embodiment, the rotational axis of the rotating shaft of the motor is substantially parallel to the sliding member 221 and the rotational axis of the rotating drive 621 is substantially perpendicular to the sliding member 221. In this embodiment, a universal joint and/or a set of gears 821 can be used to transmit the rotational motion of the rotating shaft to the rotating drive 621. Among other benefits, when the rotational axis of the rotating shaft is parallel to the sliding member 621, the height of the housing containing the motor, gears and rotating drive can be reduced.

Figure 19:
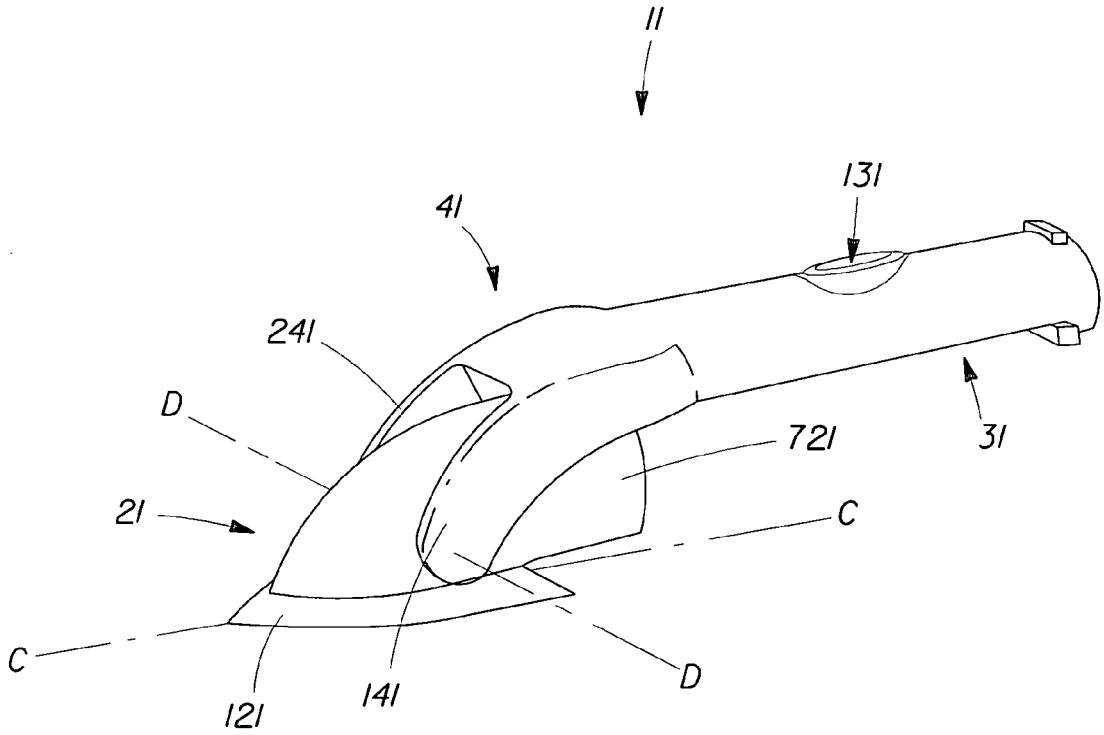
FIG. 19 is an isometric view of the implement of FIG. 16 where the handle is pushed downwards.

In one embodiment, the joint 41 of the handle 31 is a fork including a first and a second leg member 141 and 241, which are pivotably connected to the housing 721 about the D-D axis. In a preferred embodiment, the leg members 141 and 241 define a volume which can be occupied by at least a portion of the housing 721 when the handle 31 is pushed downwardly as shown in FIG. 19.

In a preferred embodiment, the handle 31 is resiliently connected to the housing 721 such that the handle 31 returns to it original position when a user releases the pressure applied on the handle 31.

Figure 20:
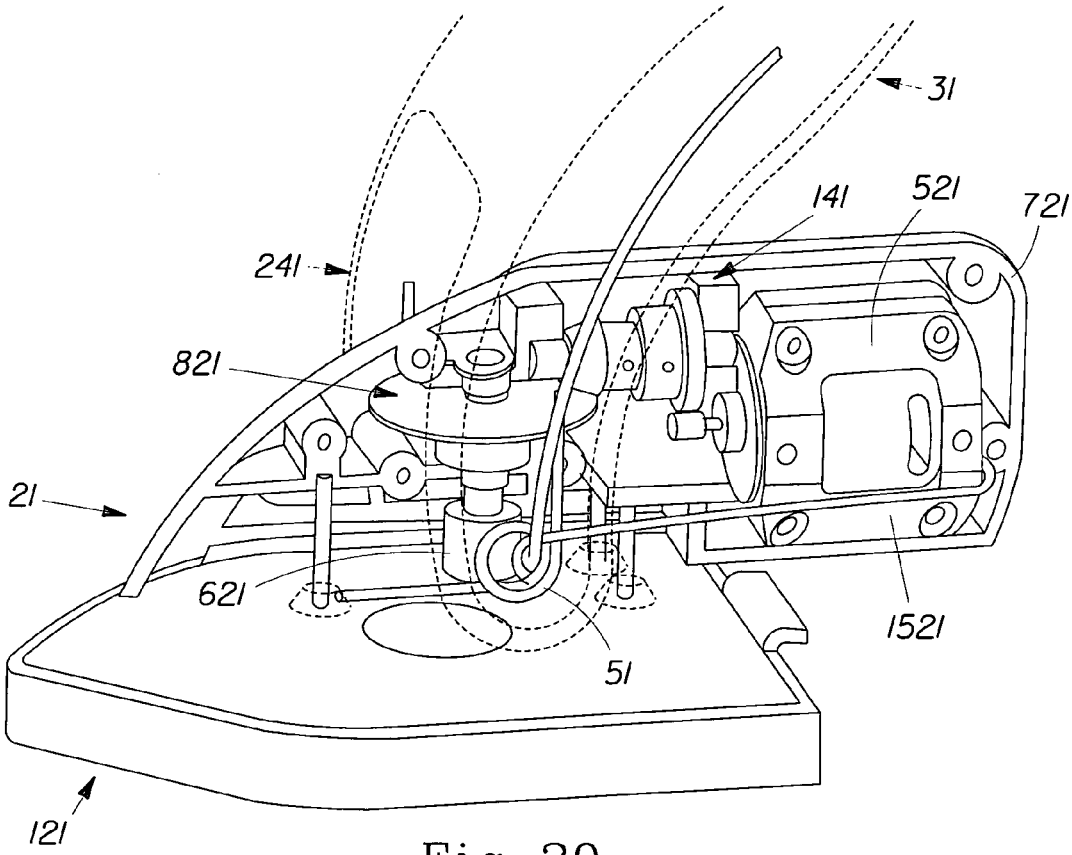
FIG. 20 is a partial enlarged view of the motorized implement of FIG. 17.

In one embodiment, the handle 31 is resiliently connected to the housing 721 via at least one but preferably two spring members 51 such as the one shown in FIG. 20. In one embodiment, a first portion of the spring member 51 can be connected to the leg member 141 and a second portion of the spring member can be connected to the housing 721. The spring member 51 can be made of any suitable resilient and/or elastic material that allows the handle 31 to return to its original position when a user ceases to apply upward or downward pressure on the handle 31. Non-limiting examples of suitable material that can be used for the spring member 51 include metal, plastic, wood and elastomeric material.

In one embodiment, the battery, which is located within the handle 31, can be electrically connected to the motor via electric cables, which can be positioned within the handle, the leg element 141 and/or 241 and then penetrate into the housing 721 through an opening made to the pivotal connection between the leg member 141 and/or 241 and the housing 721. Among other benefits, electric cables positioned within the handle and penetrating the housing through the pivotal connection allows the handle to pivot relative to the housing 721 while limiting the risk that the cable may be damaged or may be in contact with water during the cleaning operation.

Figure 21:
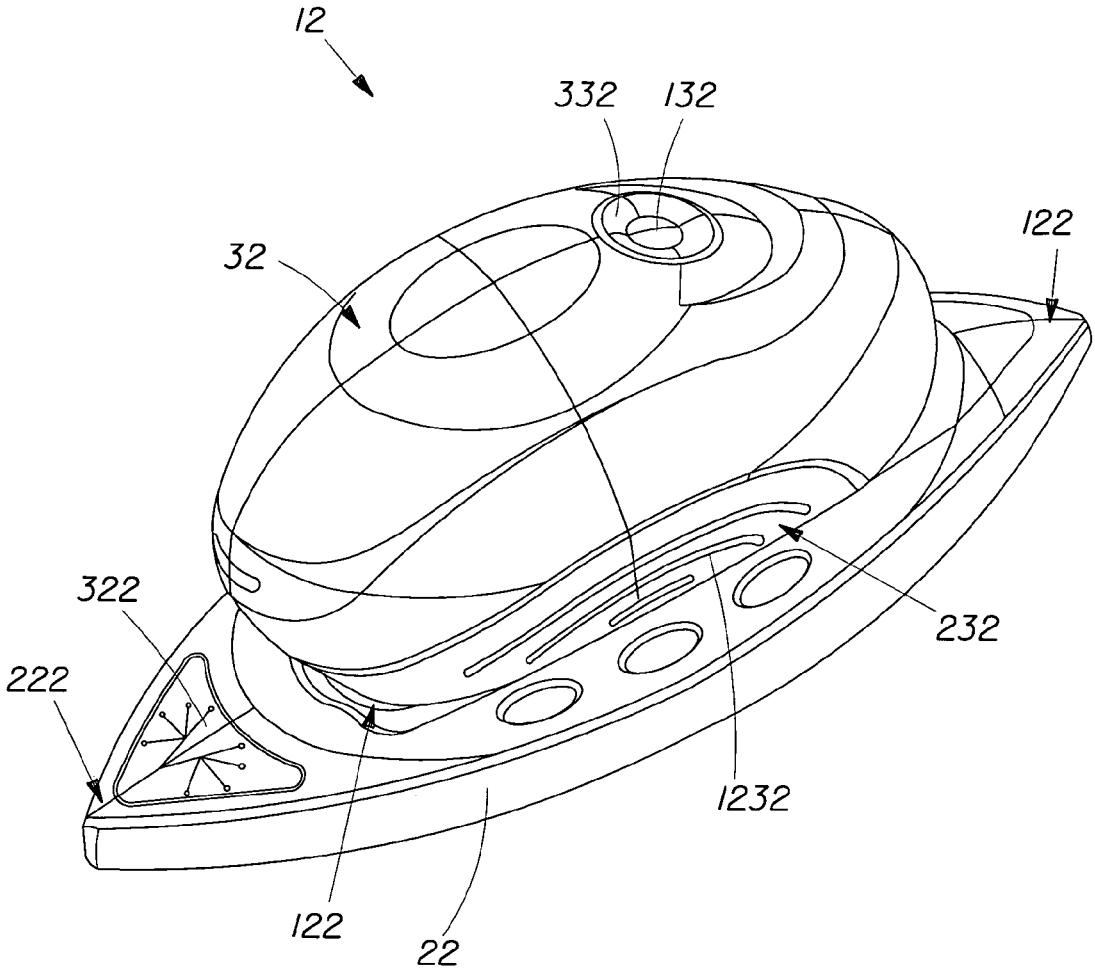
FIG. 21 is a perspective view of another motorized cleaning implement.

In one embodiment shown in FIG. 21, a motorized cleaning implement 12 includes a bumper pad 22 and a housing 32 for encasing and protecting a motor, which is electrically connected to at least one battery and a switch 132 and which is also operably connected to a sliding member 122. In a preferred embodiment, the housing 32 is substantially leak-tight and prevents a liquid from reaching the motor and any other electrical component present inside the housing. As previously discussed, the motor can be either directly but is preferably indirectly connected to the sliding member 122.

In one embodiment, the housing 32 is ergonomically shaped such that a user can apply the palm of his or her hand against the top surface of the housing 32 during the cleaning operation. In one embodiment, the outer surface of the housing 32 is substantially covex relative to the bumper pad such that a user can grab the housing with one hand. In a preferred embodiment, the housing 32 includes a concave portion 232 (relative to the bumper pad) which is preferably adjacent to the bumper pad 22. In a preferred embodiment, the concave portion 232 is present on both the left and right side of the housing 32. In one embodiment, the concave portion 232 includes at least one but preferably a plurality of protrusions 1232 for preventing the fingers of a user to slip within the convex portion when a user applies his or her fingers within this concave portion. In a preferred embodiment, the housing 32 is substantially symmetrical relative to a vertical plane. Among other benefits, a housing having a plane of symmetry allows a user to utilize the motorized implement with his or her, left or right hand.

In one embodiment, the housing is made of Acrylonitrile-butadiene-styrene, polypropylene or any injection moldable thermoplastic In a preferred embodiment, the convex portion 232 and/or the protrusions 1232 are mode of a soft material. Non-limiting examples of soft materials include ethylene vinyl acetate foam, silicone, silicone foam, styrene-butadiene rubber, thermoplastic elastomers, thermoplastic foams, thermoset foams, or polyolefins such as polypropylene blended with butadiene rubber block co-polymers that provide a softer touch and any mixtures thereof. Other benefits the materials that are soft to the touch, are that they not only provide better gripping but also anti-slipping properties when their surface is wet. For instance a thermoplastic elastomer such as styrenic block copolymer plastic under the trademark name KRATON manufactured by Kraton Polymers Inc. of Houston, Tex. KRATON provides an easy to grip surface when both wet and dry and will provide a soft surface to improve general gripping and feel on the user's hand.

In one embodiment, the switch 132 is located within a recessed portion 332 of the housing 32. In a preferred embodiment, the switch 132 is substantially adjacent to the plane of symmetry of the housing 32. Among other benefits, locating the switch 132 within the recessed portion 332 prevents that a user turns the motor ON or OFF accidentally. When a user wishes to turn the motor ON or OFF, he or she can simply insert at least the tip of a finger within the recessed portion 332 in order to contact the switch 132. One skilled in the art will understand that a switch, located in a region of the housing that is not readily accessible when the device is held by the user, oprevents that a user accidentally turns ON or OFF the motor during In one embodiment, the bumper pad 22 includes at least one tip portion 122, preferably a plurality of tip portions. In one embodiment, the bumper pad includes a first (i.e. front) tip portion 122 and a second (i.e. back) tip portion 222 which are substantially parallel to the plane of symmetry of the housing 32.

In one embodiment, the bumper pad includes at least one attachment structure 322 which is substantially adjacent to the first and/or second tip portions 122, 222.

In one embodiment, the bumper pad includes at least one attachment structure 322 that is (are) substantially adjacent to the second (i.e. back) tip portion 222.

The motorized cleaning implement including a bumper pad having an attachment structure adjacent to one of the tip portions can be used with a disposable cleaning substrate including a pocket. The first (i.e. front) tip portion can be inserted within the pocket and the "free-ends" of the substrate can be folded on top of the bumper pad and attached to the attachment structure 322.

Figure 22A:
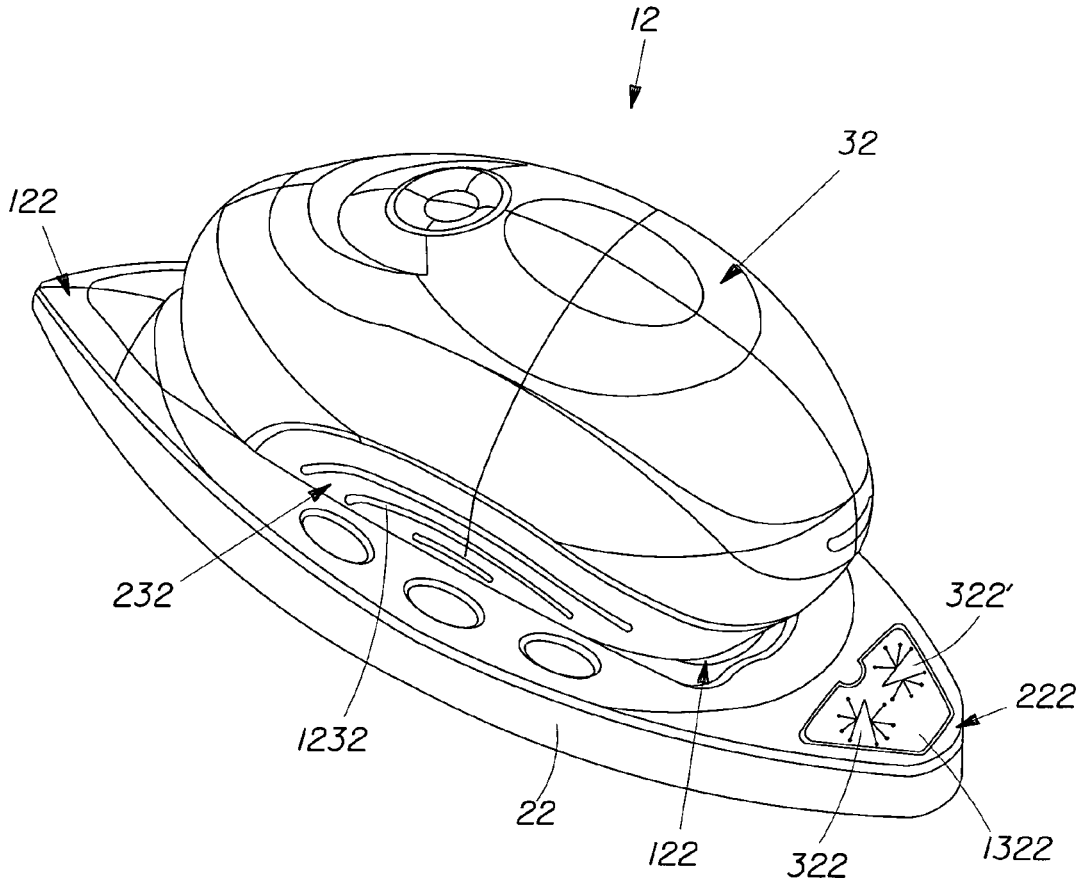
FIG. 22A is a perspective view of a motorized cleaning implement having two attachment structures.
Figure 22B:
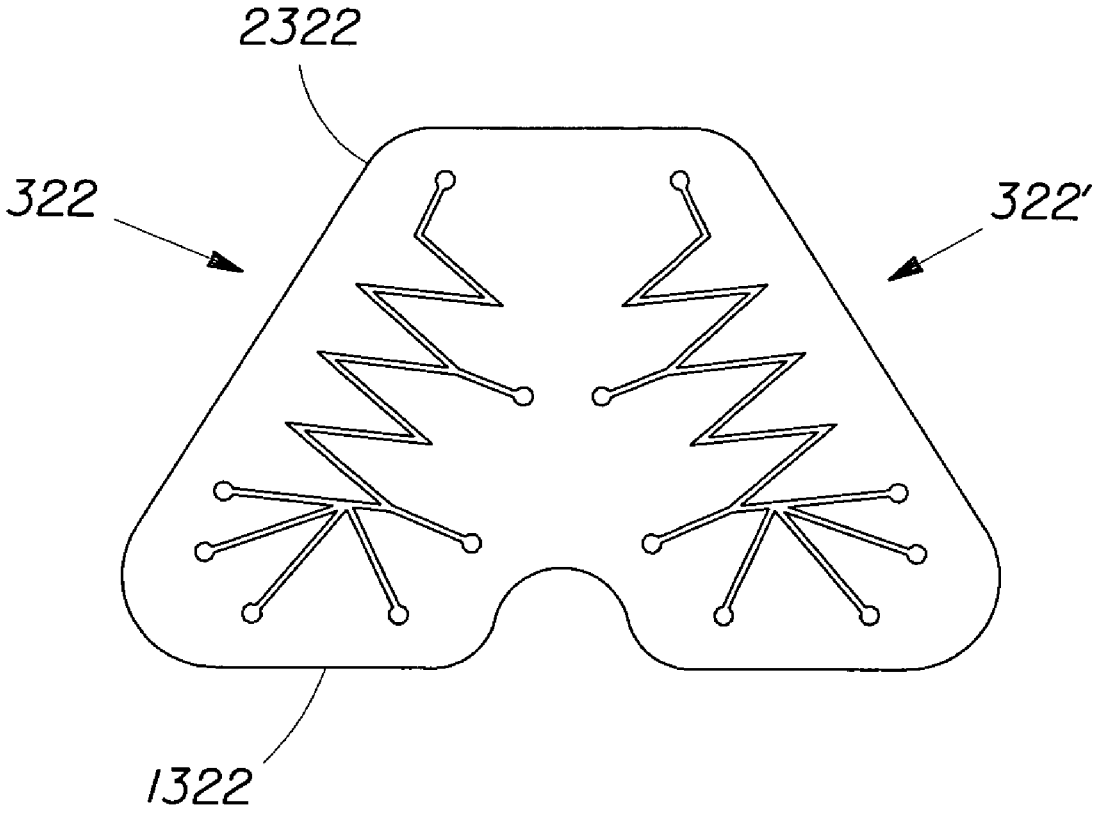
FIG. 22B is a schematic representation of an attachment structure.

In a preferred embodiment shown in FIG. 22A, the bumper pad includes a first attachment structure 322 and a second attachment structure 322' that are both substantially adjacent to the second (i.e. back) tip portion 222 and the first (i.e. front) tip portion 122 does not include an attachment structure. In one embodiment, the first and second attachment structures include a plurality of pie-shaped deflectable sections 1322 which are capable of engaging at least a portion of a cleaning substrate when the cleaning substrate is pushed within an attachment structure. The pie shaped sections are preferably pointing away from the direction of forces acted upon them by the substrate. Alternative attachment structure(s) 322 which can be included to a bumper pad is shown in FIG. 22B. The attachment structure can include a plurality of pie shaped sections 1322 having a common apex that are located in the back portion of the attachment structure and a plurality pie shaped sections 2322 each having its own apex and which are extending from the back towards the front of the attachment structure. Without intending to be bound by any theory, it is believed that the combination of pie-shaped section 1322 and 2322 within the same attachment structure provides more gripping surface to retain a cleaning substrate. The attachment structure can be formed of a single injection molded piece or of two separate pieces which are then connected to the bumper pad. The pie-shaped sections of the attachment structures are preferably made by injection molding of a thermoplastic where the mold forms these slits but alternative means of making include making slits in a layer of flexible and deformable plastic material or by any other method known in the art.

In a one embodiment, the attachment structures 322 and 322' are formed in two separate layers of plastic material which are independently connected to the bumper pad. In a preferred embodiment, the attachment structures 322, 322' are formed in the same layer of plastic which is then connected to the bumper pad. Among other benefits, a bumper pad having first and second attachment structures 322, 322' allows a user to attach each free-end or corner of a cleaning substrate independently from each other. As previously discussed, the bumper pad is capable of a reciprocating motion. Consequently, it is advantageous to provide at least two attachment structures which are individually capable of retaining a free-end of a cleaning substrate in order to prevent the cleaning substrate from getting detached from the bumper pad during the cleaning operation.

In one embodiment, the space located above the attachment structure 322, and/or if present 322', is substantially unobstructed by the housing 32 or a portion of the housing. By "substantially unobstructed" it is meant that the housing 32 does not substantially extend above the attachment structure in a manner which may prevent access to the attachment structure. As previously discussed, a user can attach the free-ends or corners of a cleaning substrate to the attachment structure by folding these free-ends on top the tip portion of the bumper pad. It is therefore beneficial to leave the space above the attachment structure substantially free of any object which may interfere and/or prevent a user to attach the substrate to the bumper pad.

Figure 22C:
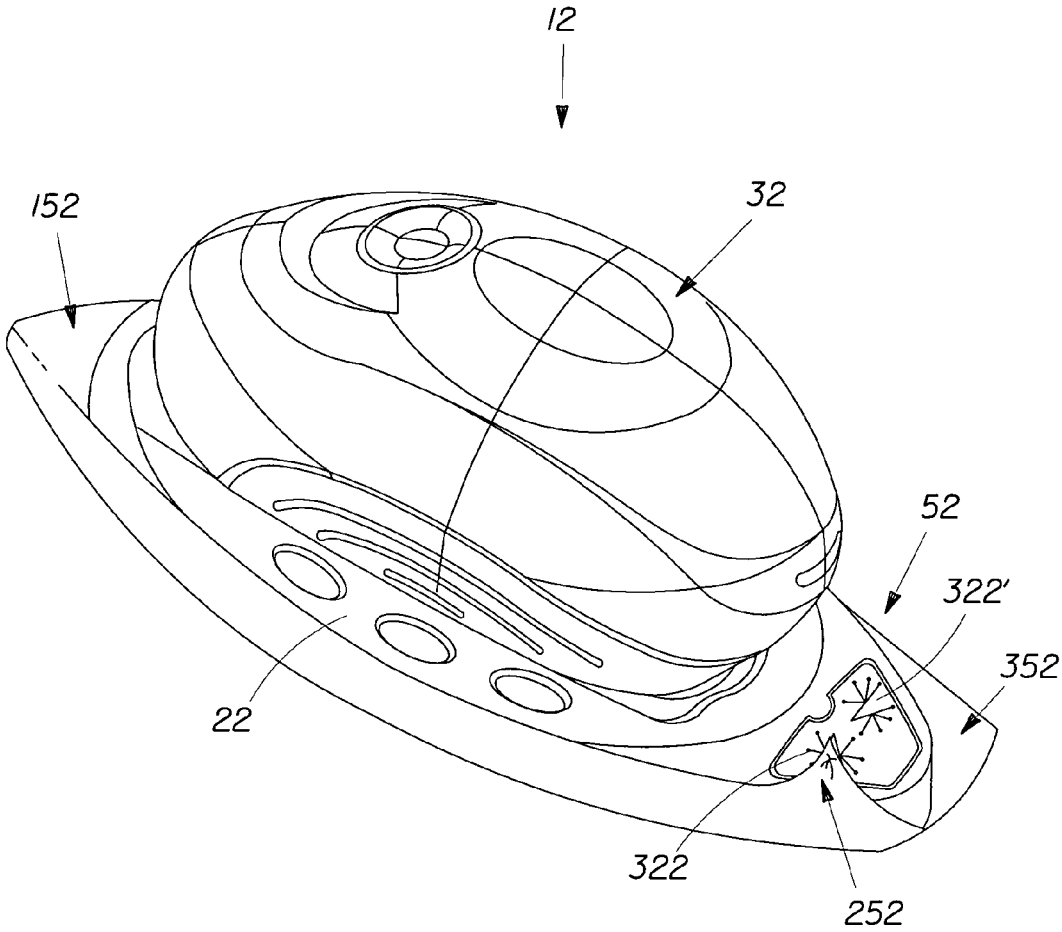
FIG. 22C is a perspective view of the motorized implement of FIG. 22A and a cleaning substrate at least partially attached to the cleaning implement.

FIG. 22C shows a cleaning substrate 52 including a pocket 152 connected to the first (i.e. front) tip portion of a bumper pad 32 and which has one of its tree-ends or corners 252, 352 engaged by one of the attachment structures 322. For clarity and explanation purposes, the second free-end of the substrate is shown before it is engaged by the second attachment structure.

When both free-ends or corners are connected to the attachment structure 322 and/or 322', the side portion of the bumper pad 32 is at least partially covered by the cleaning substrate. As a result, the side portion(s) of the bumper pad covered by the cleaning substrate can also be used to clean when a user applies the side portion of the bumper pad against a surface to be cleaned.

Figure 23A:
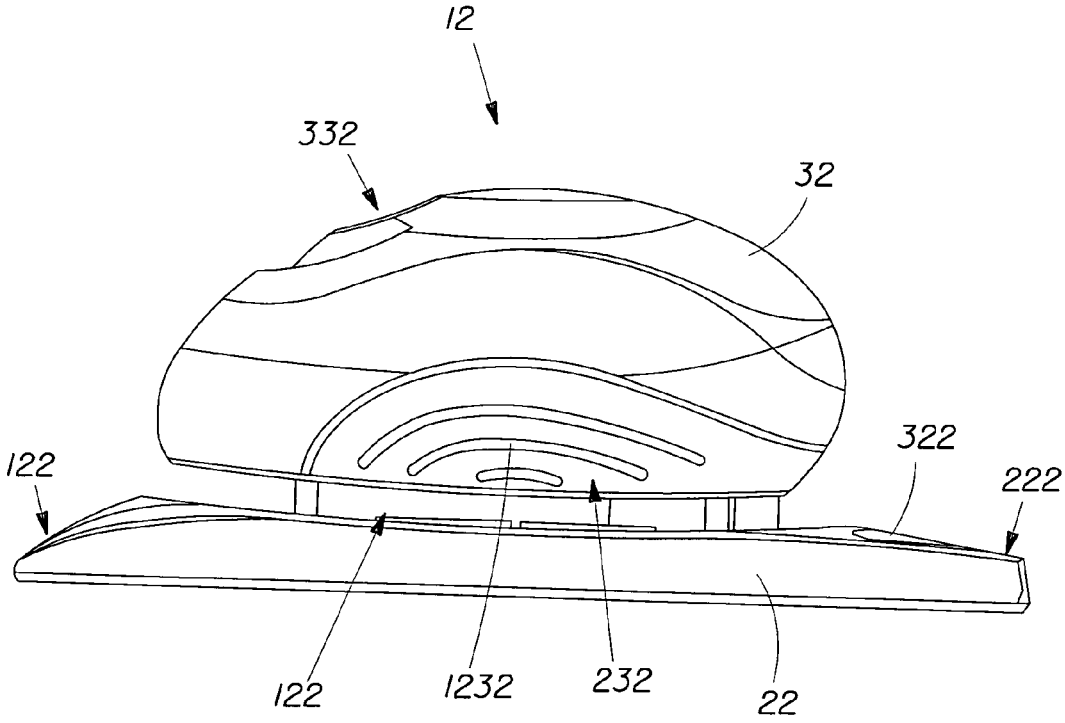
FIG. 23A is a side view of the motorized cleaning implement of FIG. 21.

In one embodiment shown in FIG. 23A, at least one of the tip portions of the bumper pad 32 is tapered. By "tapered" it is meant that the thickness at the tip potion of the bumper pad gradually increases from the tip towards the sliding member. In a preferred embodiment, the first (i.e. front) tip portion 122 is tapered and preferably does not include any attachment structure. One skilled in the art will understand that when a cleaning substrate, in particular a nonwoven cleaning substrate which includes a pocket accessible via an opening, is packaged in order to be sold, the pocket can be flattened and, as a result, the opening providing access to the pocket is reduced. When a user removes the substrate from its package, it can be difficult to insert the tip portion of a bumper pad through the opening if the pocket in the event the thickness of bumper pad at the tip is excessive. Among other benefits, a tapered tip portion allows a user to insert easily this tip portion within the "flattened" pocket of a cleaning substrate. In addition to tapering the front portion, the back end of the pad 22 can also be tapered to decrease the pad thickness in order to allow a greater portion of the corners 252 and 352 to engage the grippers 322 or 322'.

As previously discussed, the bumper pad of a non-motorized or motorized cleaning implement is preferably made of a deformable material allowing the bumper pad to conform to the shape of curved surfaces. The tip portion(s) of the bumper pad allows a user to apply more force within a smaller area/region of the bumper pad and ultimately of the cleaning substrate when the front or back tip portions are "bent" as previously shown in FIG. 10. One skilled in the art will understand that when more force is applied within a smaller region, the friction between the cleaning substrate and the surface to be cleaned increases and consequently, it is possible to remove tough stains from this surface.

When a motorized cleaning implement includes a deformable bumper pad capable of a reciprocating motion provided by a motor stored in a housing as shown in FIG. 23A, and when a user "bends" the tip portion of the bumper pad to remove tough stains from a surface, it is beneficial that the top surface of the bumper pad does not get in contact with the housing 32. Allowing the tip portion of the bumper pad to contact the housing may result in the bumper pad being damaged due to the friction between the top surface of the bumper pad and the housing but it may also damage the motor, gears and/or other components of the motorized cleaning implement.

In addition, when the tip portion is bent over a long period of time, the tip portion looses part of its elasticity and tends to be curved and remain upward.

It is found that it can beneficial to control the degree of deformability of the tip portion, especially the first (i.e. front) tip portion to prevent the issues previously discussed.

Figure 23B:
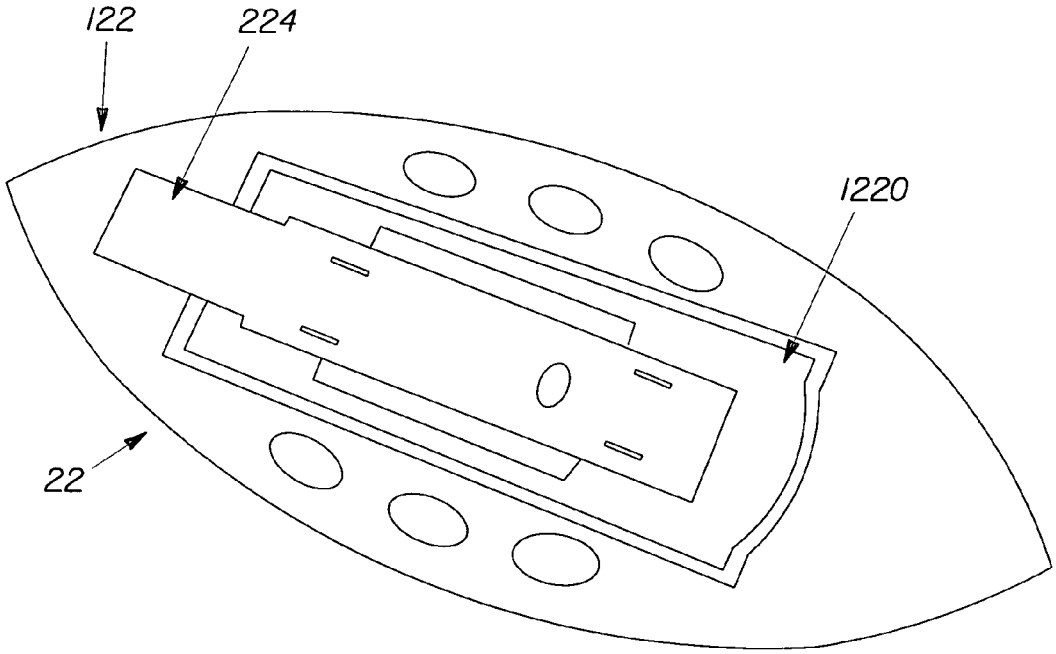
FIG. 23B is a top view of a bumper pad including a stiffening member.

FIG. 23B shows a top view of a motorized cleaning implement where the housing, the motor, batteries and gears are not shown for clarity.

In one embodiment, the cleaning implement includes a stiffening member 224 extending over at least a portion of the first tip portion 122. In a preferred embodiment the stiffening member 224 is bendable and is preferably substantially elastic such that it returns to its original shape when a force ceases to be applied to the stiffening member. In one embodiment, the stiffening member is connected to the base portion 1220 of the implement. In a preferred embodiment, the stiffening member is integrated and made with the base portion when the base portion is molded. In one embodiment, the stiffening member is applied against the top surface of the tip portion. In another embodiment, the stiffening member is at least partially located within the tip portion. In yet another embodiment, the stiffening member is fully located and/or incorporated within the tip portion of the bumper pad. The bumper pad can be formed and/or molded around the stiffening member.

The stiffening member is preferably made of a thermoplastic material that can flex slightly when pressure is applied to the tip portion. The shape, size and deformability of the stiffening member 224 are preferably such that when a user applies a force comprised between about 1 lb and 20 lbs bending the tip portion, the top surface of the tip portion and/or the stiffening member does not get in contact with the housing 32. As previously discussed, the stiffening member is preferably made of an elastic material. Among other benefits, a substantially elastic stiffening member allows the tip portion of the bumper pad to recover its original shape when a force ceases to be applied on the tip portion. A substantially elastic stiffening member substantially reduces the "shape memory loss" of the tip portion over time as previously discussed.

In addition, the stiffening member maintains a space, gap and/or clearance between the top surface of the tip portion and the housing. The presence of a gap between the top surface of the tip portion and the housing prevents the tip portion from rubbing against the housing and consequently, prevents depletion of power and/or energy of the motorized device during use.

In one embodiment, the vertical distance (i.e. in the z direction) between the lower edge of the housing and the top surface of the bumper pad and/or the stiffening member is between about 1 and 10 mm, preferably between 2 and 9 mm, more preferably between 3 and 8 mm. In one embodiment, the force required to have the tip portion and/or stiffening member touch the lower edge of the housing is at least about 1 lb, preferably at least 2 about lbs, more preferably at least about 3 lbs of force. In one embodiment, the force required to have the tip portion and/or stiffening member touch the lower edge of the housing is less than about 20 lbs, preferably less than about 10 lbs, more preferably less than about 8 lbs. The force applied to the tip portion and/or the stiffening member can be measured by first applying the bottom surface of the bumper pad against a scale. The tip portion is then forceably bent while being rotated from 0 to about 45 degrees in order to limit the contact area between the bottom of the bumper pad and the scale. The force applied on the device is increased until the top surface of the tip portion and/or stiffening member touches the lower edge of the housing and the force indicated by the scale is recorded.

III. Tensioning Mechanism

As previously discussed, the non-motorized or motorized (with or without a handle) cleaning implements can be used with a cleaning substrate (preferably a disposable cleaning substrate) which is attached to the mop head of the implement such that at least the bottom portion of the substrate contacts the surface to be cleaned.

In one embodiment shown in FIGS. 24-27, a cleaning substrate 50 can have a bottom layer 150 and a top layer 250 which are bonded together in order to form a pocket portion 350 accessible via an opening 1350. In a preferred embodiment, the shape of the pocket portion 350 conforms substantially to the shape of at least a portion of the bumper pad of a cleaning implement. One skilled in the art will understand that the cleaning substrate can be made of a single layer of material which can be folded and then bonded in order to form a pocket portion as previously discussed.

At least a portion of the bumper pad of the cleaning implement can be inserted into the pocket 350 through the opening 1350. In a preferred embodiment, the bottom layer 150 of the cleaning substrate 50 is longer than the top layer (when measured along the longitudinal axis 26-26) in order to form an extension portion 450. In one embodiment, the extension portion 450 is optionally attachable to the mop head by any mechanism known in the art.

Figure 27:
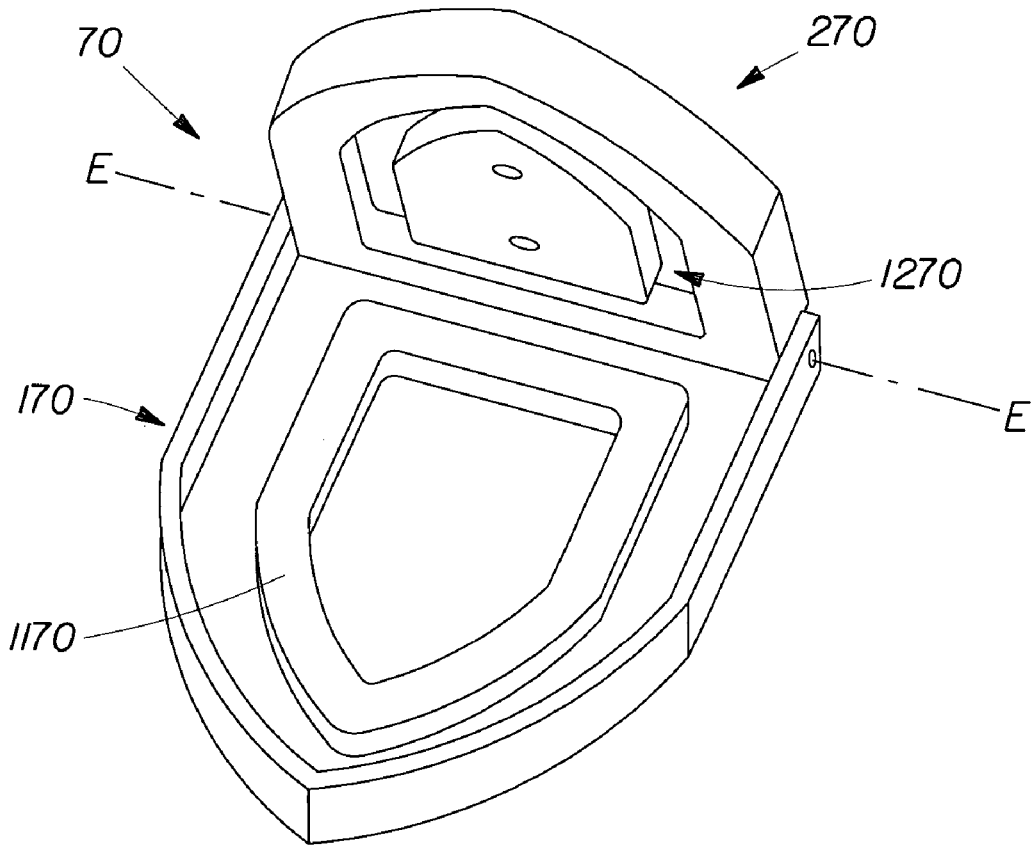
FIG. 27 is a perspective view of a tensioning mechanism in an open position.

In one embodiment, a cleaning implement includes a tensioning mechanism 70, shown in FIG. 27 in an open position) for putting the cleaning substrate under tension such that it conforms at least partially to the shape of the bumper pad of a cleaning implement.

The tensioning mechanism 70 includes a male element 170 having a three-dimensional protruding portion 1170 and a female element 270 having a corresponding three-dimensional recessed portion 1270 which can be engaged by the protruding portion 1170. The protruding portion and recessed portions can have any shape known in the art.

In one embodiment, the female element 270 is operably connected to the male element 170 such that the protruding portion 1170 engages the recessed portion 1270 when the tensioning mechanism is in a first position (or closed position), and such that the protruding portion 1170 does not engage the recessed portion 1270 when the tensioning mechanism is in a second position (or open position). In a preferred embodiment, the female element is pivotably connected to the male element 170 along the E-E axis.

Figure 28:
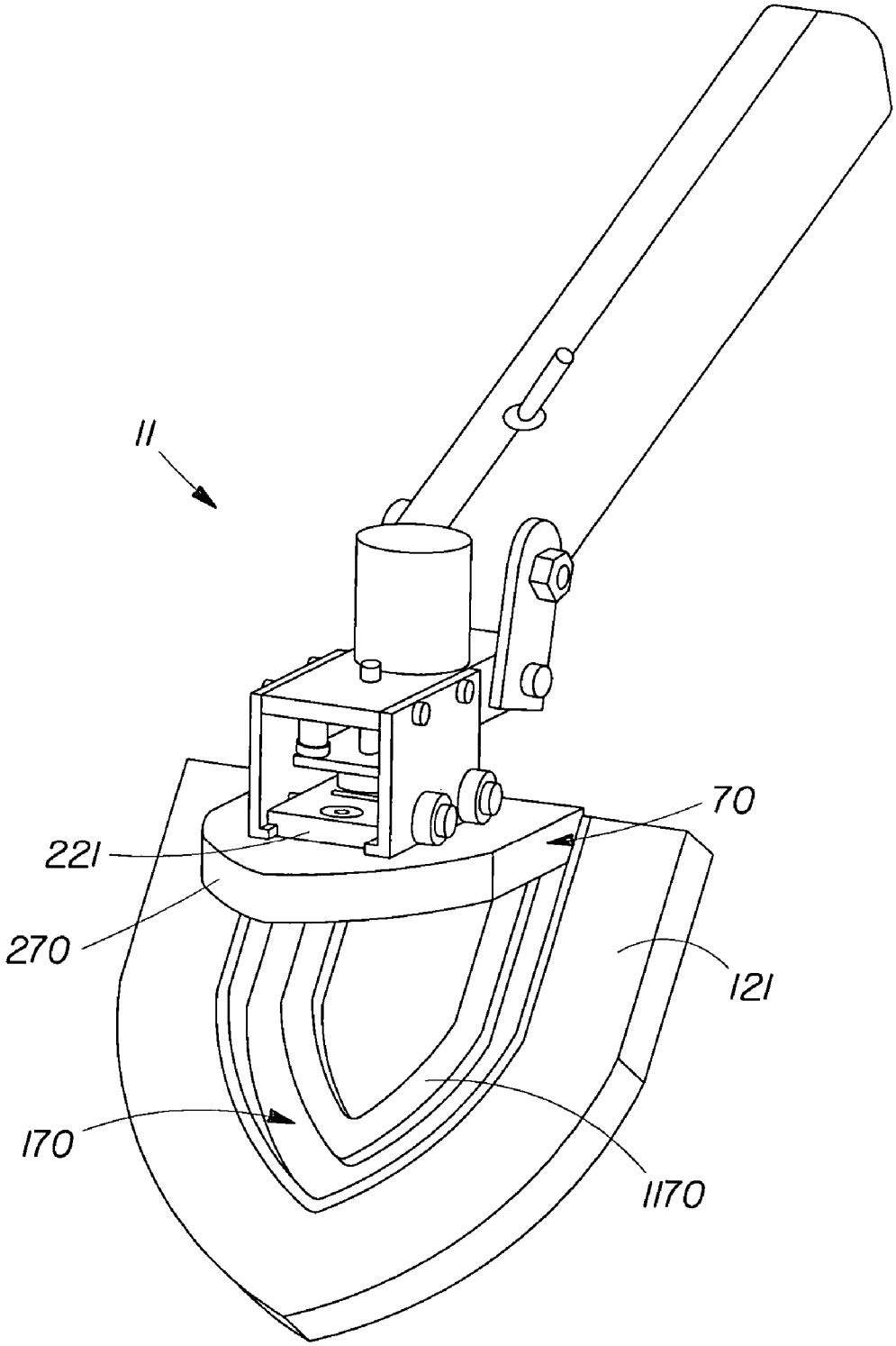
FIG. 28 is a perspective view of a cleaning implement having a tensioning mechanism in an open position.

FIG. 28 shows a motorized cleaning implement 11 including a tensioning mechanism 70 in an open position. In one embodiment, the male element 170 can be attached, preferably adhesively attached, to the bumper pad 121 and the female element 270 is pivotably connected to the male element 170 as previously discussed. It will be understood that the male element 170 can be formed directly into the bumper pad 121 (for example molded within the bumper pad) and still provide the same benefit. It will be also understood that the position of the male and female elements can be inverted (i.e. the female element can be attached to the bumper pad) and still provide the same benefits.

Figure 29:
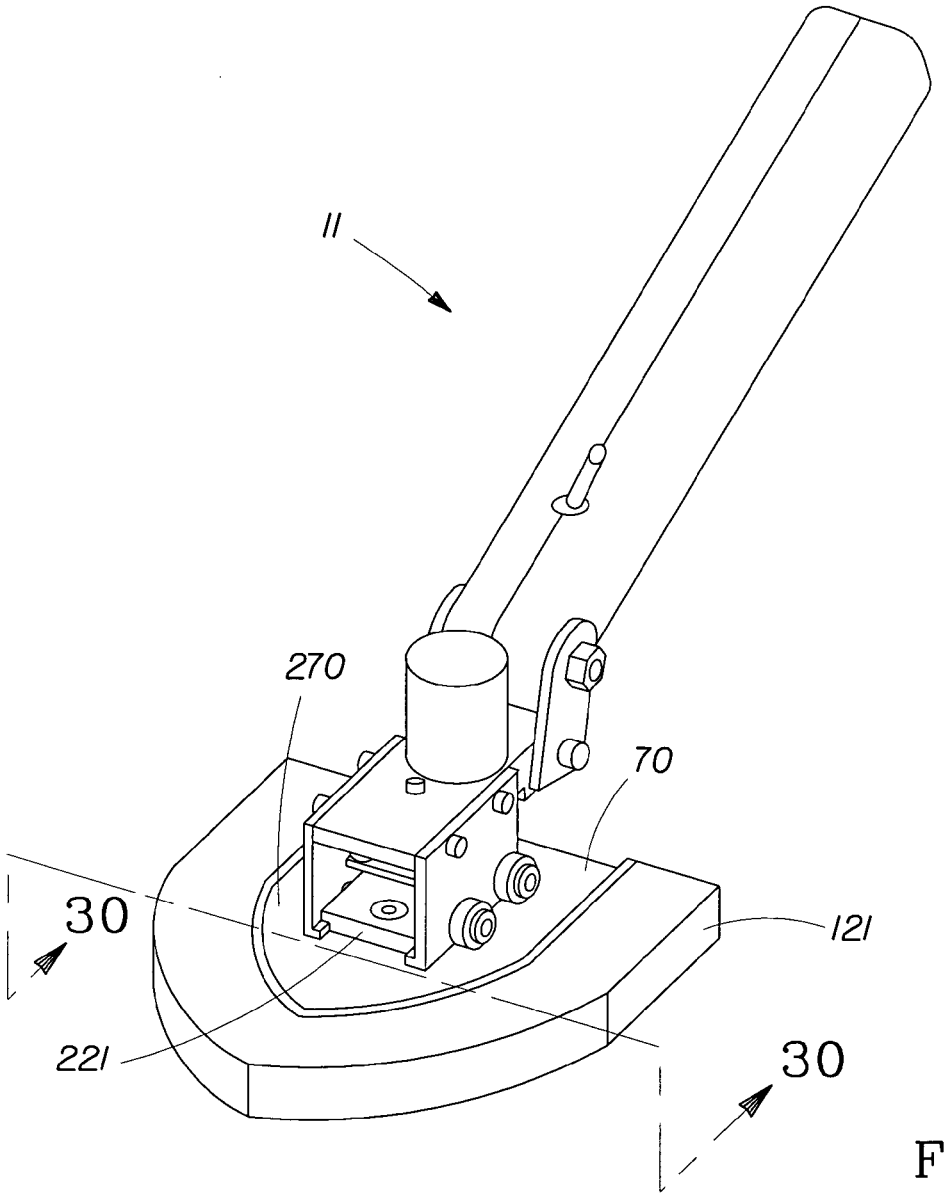
FIG. 29 is a perspective view of the cleaning implement of FIG. 28 showing the tensioning mechanism in a closed position.

FIG. 29 shows a motorized cleaning implement 11 where the tensioning mechanism 70 is in a closed position.

It will be understood that the tensioning mechanism can also be used with a non-motorized cleaning implement and still provide the same benefits.

In a preferred embodiment, the sliding member 221 of a motorized cleaning implement is connected to the top surface of the tensioning mechanism 70 such that the tensioning mechanism and the bumper pad can move longitudinally relative to the motor of the implement.

Figure 26:
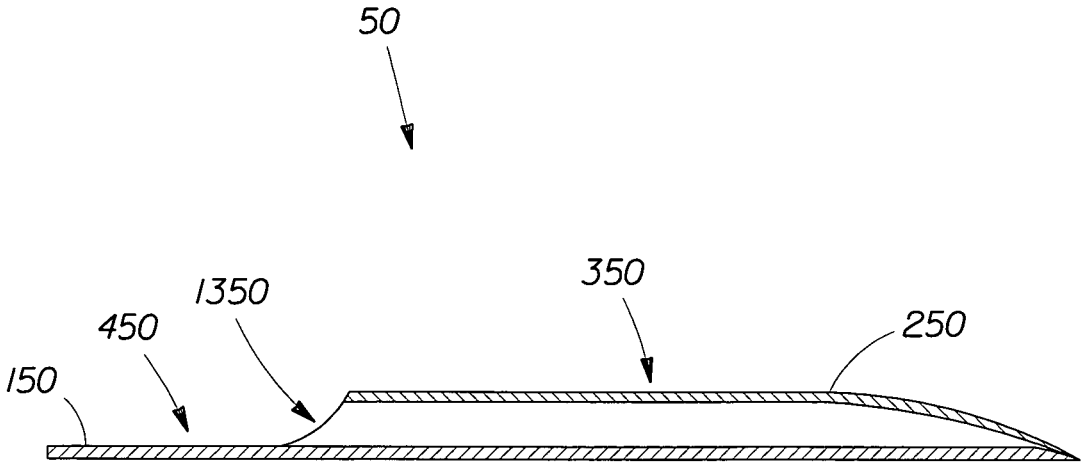
FIG. 26 is a cross-sectional view of the cleaning substrate of FIG. 24 taken along the 26-26 axis.
Figure 30:
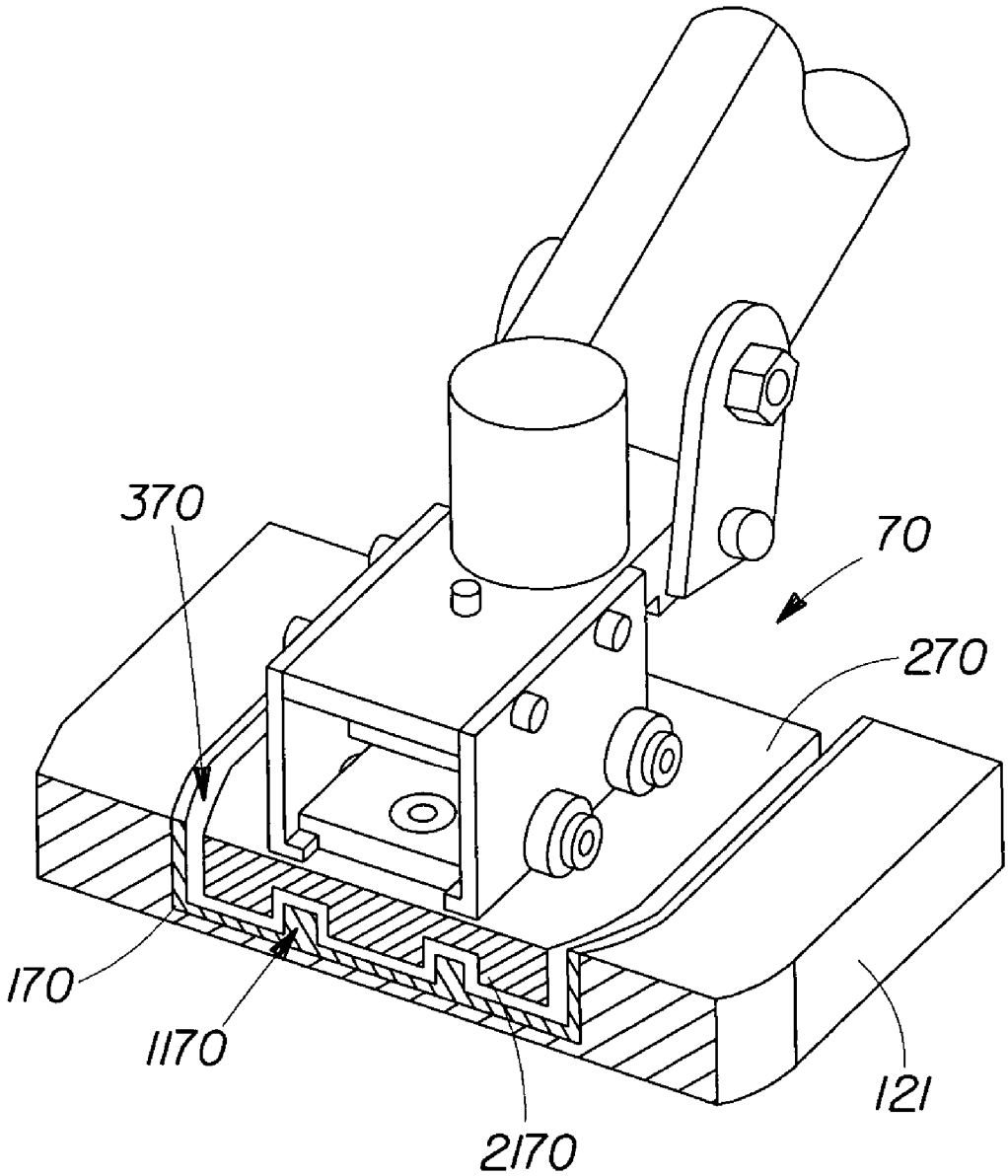
FIG. 30 is an enlarged perspective cross-sectional view of the cleaning implement of FIG. 29 taken along the 30-30 axis.

FIG. 30 is an enlarged cross-sectional view of the cleaning implement 11 shown in FIG. 26 which is taken along the 27-27 axis, and which shows the protruding portion 1170 engaging the recessed portion 1270 of the female element 270.

Figure 24:
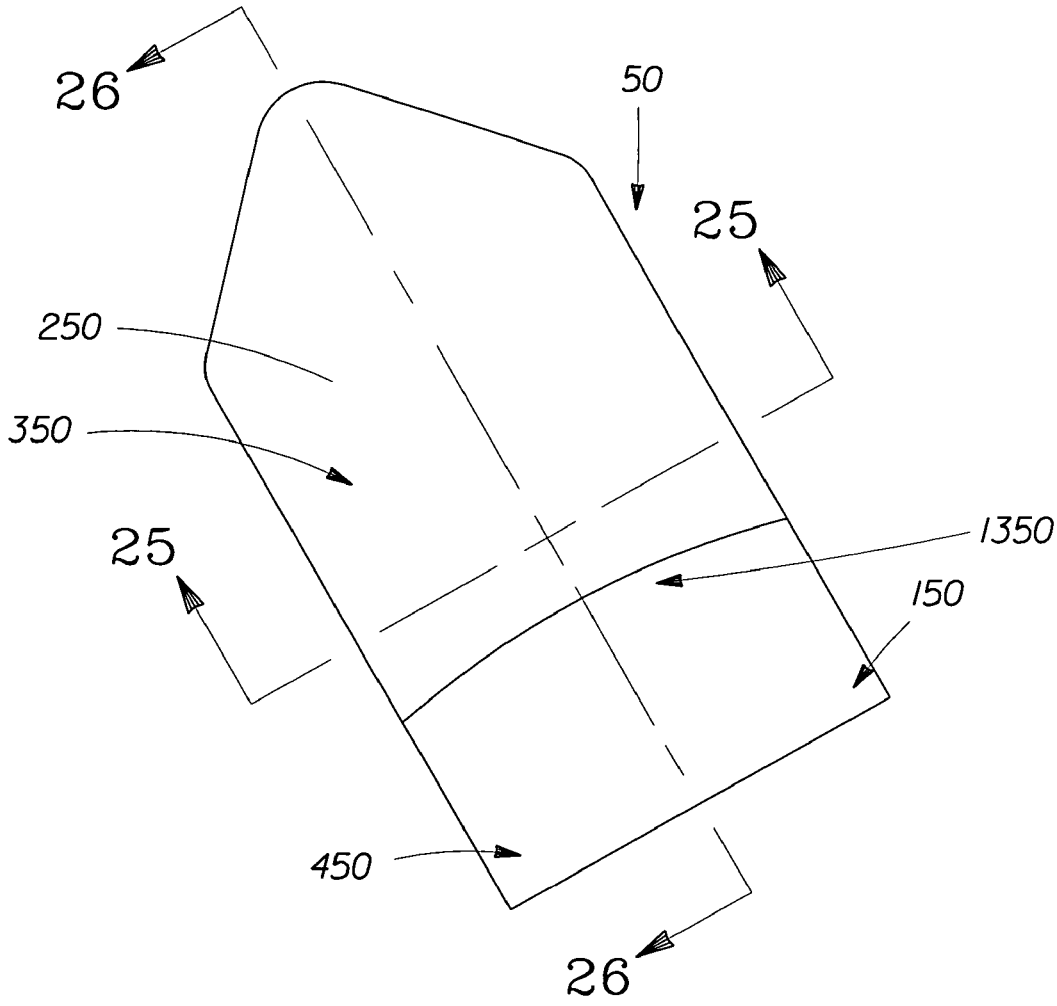
FIG. 24 is a perspective view of a cleaning substrate of the invention.
Figure 25:
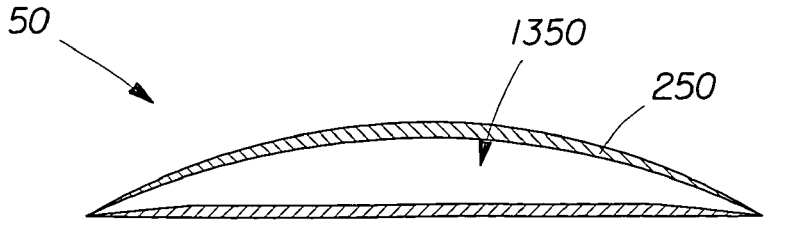
FIG. 25 is a right side view of the cleaning substrate of FIG. 24.
Figure 31:
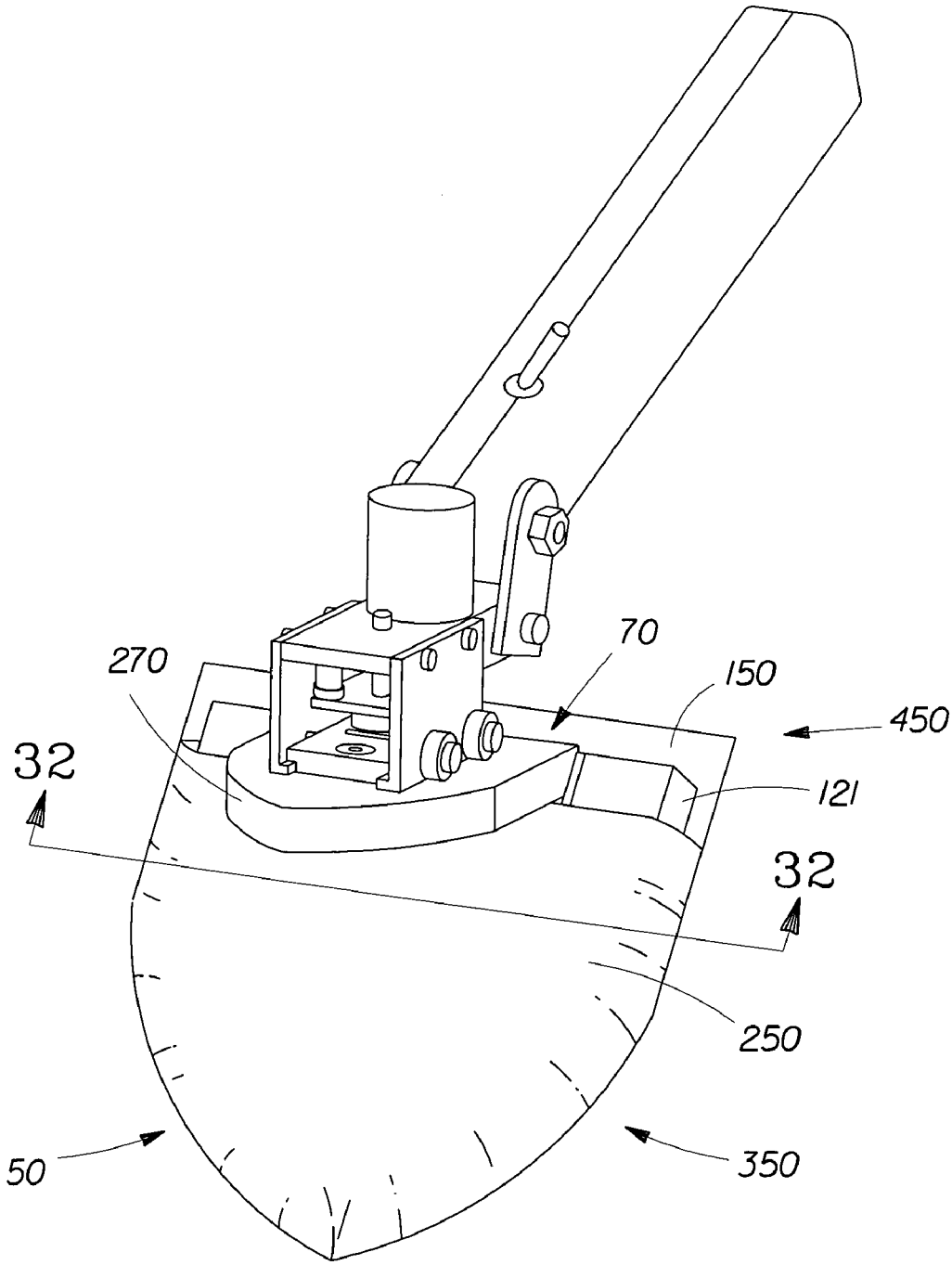
FIG. 31 is a perspective view of a cleaning implement and a cleaning substrate.

When the tensioning mechanism 70 is in the second (or open) position as shown in FIGS. 28 and 31, a user can insert at least a portion of the bumper pad 121 into the pocket portion 350 of the cleaning substrate 50 shown in FIGS. 24-26 such that the top layer 250 of the substrate 50 covers at least a portion of the male element 170 of the tensioning mechanism. Once a user has inserted the bumper pad into the pocket portion of the cleaning substrate, the user can close the tensioning mechanism such that the male element engages the female element such that the top layer 250, which is "sandwiched" between the male and female elements, is forced to follow the three-dimensional path created by the male and female elements. In a preferred embodiment, a gap 370 (shown in FIG. 30) separates the protruding portion 1170 from the recessed portion 2170 such that a portion of the top layer 250 is located within the space created by this gap when the tensioning mechanism is closed.

Figure 32:
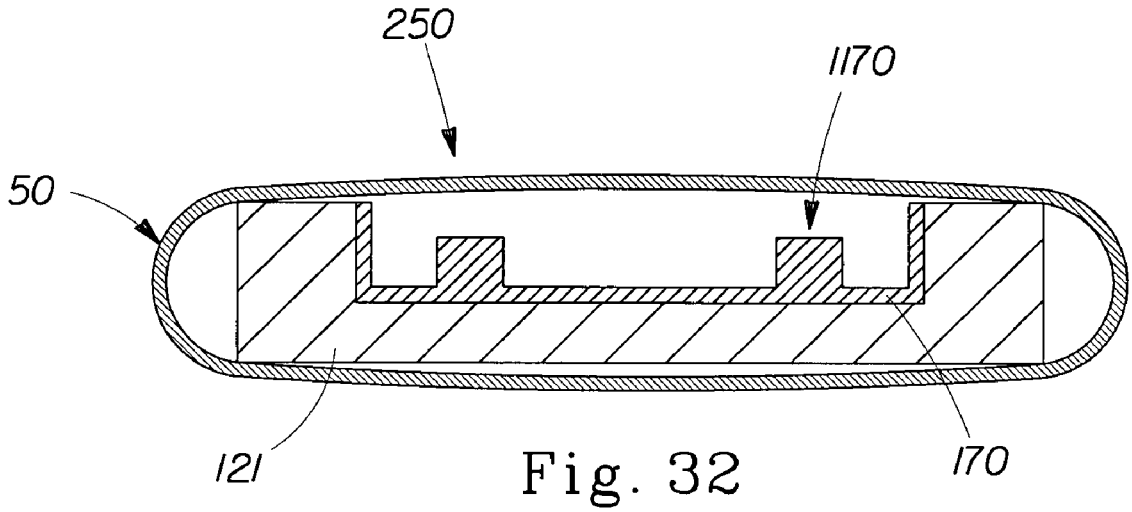
FIG. 32 is a cross-sectional view showing a portion of a bumper pad inserted into the pocket portion of a substrate and a tensioning mechanism in an open position.

FIG. 32 is a planar cross-sectional view taken along the 32-32 axis (shown in FIG. 31) showing the tensioning mechanism in an open position where the bumper pad 121 has been inserted in the pocket portion of the cleaning substrate 50.

Figure 33:
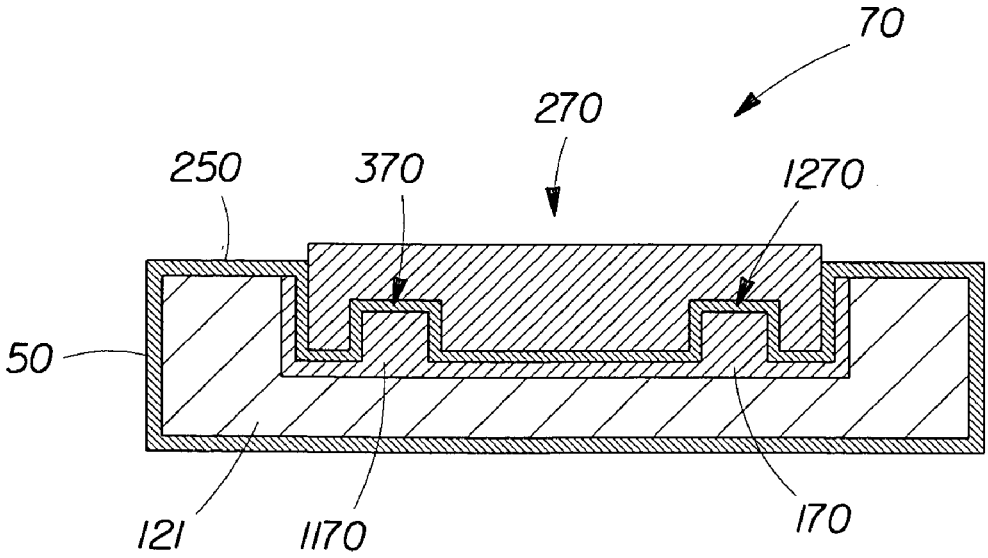
FIG. 33 is a cross-sectional view of the implement of FIG. 31 showing the tensioning mechanism in a closed position.

When the tensioning mechanism is closed as shown in FIG. 33, the top layer is forced to occupy the space created by the gap 370 in between the protruding portion 1170 of the male element 170 and the recessed portion 1270 of the female element 270. In one embodiment, the distance between the male and female elements in a closed position is between about 0.1 mm and 10 mm, preferably between about 0.5 mm and about 5 mm, more preferably between 0.7 mm and about 2 mm. When the tensioning mechanism 70 is closed, the top layer 350 is put under tension, which in turn, causes the cleaning substrate to be tightly held against the outer surface of the bumper pad 121 as shown in FIG. 33. Consequently, the tensioning mechanism reduces the slack of the pocket portion which allows the bumper pad to be inserted into the pocket portion.

Among other benefits, the tensioning mechanism provides a retaining mechanism for maintaining the cleaning substrate attached to the mop head of the cleaning implement during the cleaning operation. In addition, the tensioning mechanism reduces the slack of the pocket. In the context of a motorized cleaning implement, it is also beneficial to remove this slack in order to have the cleaning substrate and the bumper pad move relative to the motor. On skilled in the art will understand that if the bumper pad were substantially free to move relative to the cleaning substrate within its pocket portion, the movement of the cleaning substrate relative to the motor can be limited.

In addition, the cleaning efficiency of the cleaning substrate used with a cleaning implement is increased when the substrate is tightly held against the bumper pad and a greater portion of the cleaning substrate (the bottom surface and the side surfaces) can be used to clean.

As previously discussed, the non-motorized or motorized cleaning implement can be used with a disposable cleaning substrate, preferably a substrate including a nonwoven material. This disposable cleaning substrate can be substantially dry or include a cleaning composition (either liquid or paste) impregnated onto the substrate.

In one embodiment, a user can attach the cleaning substrate to the bumper pad of the motorized implement and then the user can turn the switch on in order to have both the cleaning substrate and the bumper pad move back and forth along the C-C axis. A user can then apply the bottom surface of the cleaning substrate against the surface to be cleaned in order to remove soils present on this surface. When the cleaning substrate moves back and forth against the surface to be cleaned at a sliding frequency of between about 3 Hz and 40 hz and a displacement amplitude of between about 1 mm and about 30 mm, a user can clean a surface effortlessly while applying minimum pressure on the handle. It should be noted that the motorized cleaning implement can also be used when the switch is turned off but a user is then required to move the bumper pad back and forth.

When a user wishes to remove tough stains, or a user wishes to scrub a surface thoroughly, the user can apply upward or downward pressure on the handle while still having the cleaning substrate move back and forth.

When the motorized cleaning implement is used to clean curved surfaces such as bathtubs, sinks and the like, a deformable and elastic bumper pad as previously described allows the cleaning substrate to conform to the surface being cleaned while still being able to be moved back and forth.

In addition, when a cleaning substrate is attached to the bumper pad such that it covers the sides and the bottom surface of the bumper pad, the cleaning substrate can be used to clean multiple surfaces at the same time. For example, a cleaning substrate covering the bottom surface of the bumper pad and an adjacent side of the bumper pad can be used to clean surfaces formed by two substantially perpendicular walls. In one embodiment, at least a portion of one of the right or left sides of the bumper pad can be, substantially parallel to the longitudinal axis C-C (i.e. the axis along which the bumper pad translates back and forth). In a preferred embodiment, portions of both the left and right sides are substantially parallel to the longitudinal axis C-C. In addition, when the bumper pad includes at least one tip portion (as discussed in the context of the non-motorized implement) and the cleaning substrate covers the bottom and sides of this tip portion, the cleaning substrate can be used to clean corners formed by three substantially perpendicular walls or surfaces formed by two parallel walls connected by a perpendicular wall such as for example shower tracks.

Methods of Cleaning a Surface

The motorized or non-motorized cleaning devices previously described can be used for cleaning, polishing, scrubbing, or prepping any surface inside or outside a home or commercial business. Non-limiting examples of surfaces which can be cleaned with such devices include floors, countertops, bathtubs, shower stalls, car exteriors, wheels, tools, furniture, glass doors, exterior furniture, wooden structures, concrete, asphalt, brick, vinyl siding, bathroom fixtures, and any other surface that is difficult to clean and/or reach. Both the motorized and non-motorized cleaning devices can optionally but preferably include an extension pole that can be attached to provide scrubbing in areas that are hard to reach.

The foregoing description of the preferred embodiments of the invention has been presented for purposes of illustration and description. It is not intended to be exhaustive or to limit the invention to the precise form disclosed. Modifications or variations are possible and contemplated in light of the above teachings by those skilled in the art, and the embodiments discussed were chosen and described in order to best illustrate the principles of the invention and its practical application. It is intended that the scope of the invention be defined by the claims appended hereto and which should be construed as broadly as the prior art will permit.

What is claimed is:

1. A motorized cleaning implement for cleaning a surface comprising:

a substantially deformable bumper pad for retaining a cleaning substrate, said bumper pad having a top surface, a bottom surface, and a thickness;

a motor for causing said bumper pad to move relative to said motor in a reciprocating motion, wherein said motor is operably connected to said bumper pad; and a disposable cleaning substrate removably connected to at least a portion of said bumper pad; said bumer pad comprising weakness means for facilitating the deformation of said bumper pad, wherein said weakness means extend through at least a portion of the thickness of said bumper pad from said top surface or said bottom surface, said weakness means being selected from the group consisting of slits made through a portion of the thickness of said bumper pad from said top or bottom surface, slits made through the whole thickness of said bumper pad, cavities made on said top or bottom surface of said bumper pad, openings extending through the entire thickness of said bumper pad, and any combination thereof.

2. The motorized cleaning implement of claim 1 further comprising a housing wherein said motor is located within said housing.

3. The motorized cleaning implement of claim 2 wherein said housing has a top portion having substantially a convex shape.

4. The motorized cleaning implement of claim 3 wherein said housing includes a concave portion that is substantially adjacent to said bumper pad.

5. The motorized cleaning implement of claim 1 wherein said cleaning substrate comprises a pocket and said bumper pad includes at least one tip portion inserted within said pocket.

6. The motorized cleaning implement of claim 5 wherein said tip portion inserted within said pocket is tapered.

7. The motorized cleaning implement of claim 1 wherein said bumper pad comprises at least one attachment structure for engaging at least a portion of said cleaning substrate.

8. The motorized cleaning implement of claim 7 wherein said attachment structure is substantially adjacent to a tip portion of said bumper pad.

9. The motorized cleaning implement of claim 8 wherein the space above said attachment structure is substantially unobstructed.

10. The motorized cleaning implement of claim 1 wherein said bumper pad comprises a bottom surface and a side surface and wherein said cleaning substrate covers at least a portion of said bottom surface and said side surface.

11. The motorized cleaning implement of claim 1 wherein said bumper pad reciprocates at a frequency of between about 5 Hz and about 50 Hz.

12. The motorized cleaning implement of claim 11 wherein said bumper pad reciprocates at a displacement amplitude of between about 1 mm and about 30 mm.

13. The motorized cleaning implement of claim 1 wherein said bumper pad comprises a tip portion and first and second attachment structures for engaging said cleaning substrate.

14. The motorized cleaning implement of claim 13 wherein said first and second attachment structures are substantially adjacent to said tip portion.

15. The motorized cleaning implement of claim 1 wherein said cleaning substrate comprises at least one layer of a non-woven material.

16. The motorized cleaning implement of claim 15 wherein said cleaning substrate comprises a cleaning composition.

17. The motorized cleaning implement of claim 1 wherein said bumper pad has a substantially continuous outer surface.

18. The motorized cleaning implement of claim 17 wherein said bumper pad comprises a material having a type A durometer of less than about 60.

19. The motorized cleaning implement of claim 1 wherein said bumper pad comprises a deformable tip portion.

20. The motorized cleaning implement of claim 19 further comprising a stiffening member wherein said stiffening member is connected to at least a portion of said deformable tip portion.

21. The cleaning implement of claim 1 wherein said weakness means comprise a plurality of openings extending through the entire thickness of said bumper pad.

22. The cleaning implement of claim 21 wherein said bumper pad has between 1 and 50 of said openings.

23. The cleaning implement of claim 1 further comprising a handle.

24. The cleaning implement of claim 23 further comprising a hand-grip.

25. A cleaning implement according to claim 24, comprising;

a handle;

a hand-grip for allowing a user to hold the cleaning implement with one hand and clean a surface, said hand-grip pivotally connected to said implement.

26. The cleaning implement of claim 25 additionally comprising a locking mechanism for temporarily locking said hand-grip.

* * * * *

UNITED STATES PATENT AND TRADEMARK OFFICE

CERTIFICATE OF CORRECTION

PATENT NO. : 7,516,508 B2
APPLICATION NO. : 11/070145
DATED : April 14, 2009
INVENTOR(S) : A. Bryon Stackpole, Jr. et al.

It is certified that error appears in the above-identified patent and that said Letters Patent is hereby corrected as shown below:

Column 8

Line 11, delete "1.0" and insert --10--.

Column 10

Line 54, delete "3.20" and insert --320--.

Column 13

Line 63, delete "1.5" and insert --15--.

Column 15

Line 32, after the word thermoplastic, insert a period --.--.

Column 17

Line 7, delete "tree-ends" and insert --free-ends--.

Column 22

Line 11, delete "bumer" and insert --bumper--.

Signed and Sealed this

Twenty-third Day of February, 2010

David J. Kappos

David J. Kappos
*Director of the United States Patent and Trademark Office*